US010196858B2

(12) United States Patent
Feddema et al.

(10) Patent No.: US 10,196,858 B2
(45) Date of Patent: Feb. 5, 2019

(54) DOWNHOLE TOOL FOR VERTICAL AND DIRECTIONAL CONTROL

(71) Applicant: SANVEAN TECHNOLOGIES, Katy, TX (US)

(72) Inventors: Chad Feddema, Conroe, TX (US); Stephen Jones, Cypress, TX (US); Junichi Sugiura, Bristol (GB)

(73) Assignee: Sanvean Technologies LLC, Katy, TX (US)

( * ) Notice: Subject to any disclaimer, the term of this patent is extended or adjusted under 35 U.S.C. 154(b) by 118 days.

(21) Appl. No.: 15/400,688

(22) Filed: Jan. 6, 2017

(65) Prior Publication Data

US 2017/0198525 A1 Jul. 13, 2017

Related U.S. Application Data

(60) Provisional application No. 62/344,940, filed on Jun. 2, 2016, provisional application No. 62/276,676, filed on Jan. 8, 2016.

(51) Int. Cl.

| | |
|---|---|
| ***E21B 7/06*** | (2006.01) |
| ***E21B 34/14*** | (2006.01) |
| ***E21B 47/00*** | (2012.01) |
| ***E21B 47/18*** | (2012.01) |
| ***E21B 23/04*** | (2006.01) |
| ***E21B 17/10*** | (2006.01) |

(52) U.S. Cl.

CPC ..... *E21B 7/06* (2013.01); *E21B 7/062* (2013.01); *E21B 17/1014* (2013.01); *E21B 23/04* (2013.01); *E21B 34/14* (2013.01); *E21B 47/00* (2013.01); *E21B 47/187* (2013.01)

(58) Field of Classification Search

CPC ... E21B 7/06; E21B 7/062; E21B 7/04; E21B 7/064; E21B 7/067; E21B 17/10; E21B 17/1078; E21B 44/00; E21B 34/14; E21B 47/00; E21B 47/187

See application file for complete search history.

(56) References Cited

U.S. PATENT DOCUMENTS 1,758,124 A 5/1930 Mueller
6,516,900 B1 * 2/2003 Tokle ..... E21B 7/062 166/241.1

(Continued)

FOREIGN PATENT DOCUMENTS

EP 0809057 A1 11/1997

OTHER PUBLICATIONS

International Search Report and Written Opinion issued in Application No. PCT/US17/12584, dated Jun. 9, 2017, 11 pages.

*Primary Examiner* — Yong-Suk Ro
(74) *Attorney, Agent, or Firm* — Adolph Locklar

(57) ABSTRACT

A downhole steering tool includes one or more steering blades selectively extendable from a housing. Each steering blade may be extended by fluid pressure within a steering cylinder. Each steering cylinder may be coupled to the interior of a mandrel positioned within the housing through an adjustable orifice. The adjustable orifice may be moved between an open and a partially open position. The adjustable orifice may be solenoid controlled or controlled by a ring valve. The adjustable orifice may generate one or more pressure pulses to transmit data to the surface.

39 Claims, 20 Drawing Sheets

(56) References Cited

U.S. PATENT DOCUMENTS

| | | | | |
|---|---|---|---|---|
| 8,104,548 | B2 * | 1/2012 | Ma | E21B 7/06 175/61 |
| 2005/0109542 | A1 * | 5/2005 | Downton | E21B 7/062 175/73 |
| 2009/0173541 | A1 | 7/2009 | Tulloch et al. | |
| 2014/0262507 | A1 * | 9/2014 | Marson | E21B 7/10 175/24 |
| 2015/0107902 | A1 | 4/2015 | Downton | |
| 2016/0060960 | A1 | 3/2016 | Parkin et al. | |

* cited by examiner

DOWNHOLE TOOL FOR VERTICAL AND DIRECTIONAL CONTROL

CROSS-REFERENCE TO RELATED APPLICATIONS

This application is a nonprovisional application that claims priority from U.S. provisional application No. 62/276,676, filed Jan. 8, 2016, and from U.S. provisional application No. 62/344,940, filed Jun. 2, 2016.

TECHNICAL FIELD/FIELD OF THE DISCLOSURE

The present disclosure relates generally to downhole drilling tools, and specifically to anti-rotation and steering devices for downhole tools.

BACKGROUND OF THE DISCLOSURE

When drilling a wellbore, maintaining a vertical drilling direction may be desired. However, slight deflections of the bottom-hole assembly (BHA) drill string may cause the wellbore to deviate from the vertical axis and thus the wellbore may not propagate as planned. Vertical control devices may be utilized to correct deviation from vertical. Likewise, steerable systems may be utilized to control the direction of propagation of the wellbore. Typically, these devices may include a rotating section, including the drill bit and any associated shafts, and a non-rotating section which remains substantially non-rotating relative to the surrounding formation.

Steerable drilling systems are often classified as either "point-the-bit" or "push-the-bit" systems. In point-the-bit systems, the rotational axis of the drill bit is deviated from the longitudinal axis of the drill string generally in the direction of the wellbore. The wellbore may typically be propagated in accordance with a three-point geometry defined by upper and lower stabilizer touch points and the drill bit. The angle of deviation of the drill bit axis, coupled with a finite distance between the drill bit and the lower stabilizer, results in a non-collinear condition that generates a curved wellbore.

In push-the-bit systems, the non-collinear condition may be achieved by causing one or both of upper and lower stabilizers, for example via blades or pistons, to apply an eccentric force or displacement to the BHA to move the drill bit in the desired path. Steering may be achieved by creating a non-collinear condition between the drill bit and at least two other touch points, such as upper and lower stabilizers, for example.

SUMMARY

The present disclosure provides for a downhole tool. The downhole tool may include a housing rotatably coupled to and positioned about a mandrel. The downhole tool may include a steering blade positioned on the housing. The steering blade may be extendable by an extension force to contact a wellbore, the extension force caused by a differential pressure between a steering cylinder and a pressure in a surrounding wellbore. The differential pressure may be caused by fluid pressure of a fluid within the steering cylinder. The steering cylinder may be positioned within the housing. The steering blade may be at least partially positioned within the steering cylinder. The steering cylinder fluidly coupled to a steering port. The downhole tool may include an adjustable orifice. The adjustable orifice may be fluidly coupled between the interior of the mandrel and the steering cylinder. The adjustable orifice may be adjustable between an open position and at least one of a partially open position and a closed position.

The present disclosure provides for a method. The method may include providing a downhole tool. The downhole tool may include a housing rotatably coupled to and positioned about a mandrel. The downhole tool may include a first steering blade positioned on the housing. The first steering blade may be extendable by an extension force to contact a wellbore, the extension force caused by a first differential pressure between a first steering cylinder and a pressure in a surrounding wellbore. The first differential pressure may be caused by fluid pressure of a fluid within the first steering cylinder. The first steering cylinder may be within the housing. The first steering blade may be at least partially positioned within the first steering cylinder. The first steering cylinder may be fluidly coupled to a steering port. The downhole tool may include a first adjustable orifice. The first adjustable orifice may be fluidly coupled between an interior of the mandrel and the first steering cylinder. The first adjustable orifice may be adjustable between an open position and at least one of a partially open position and a closed position. The method may include positioning the downhole tool in the wellbore. The method may include supplying the fluid to the interior of the mandrel, the fluid at a pressure higher than the pressure in the surrounding wellbore. The method may include partially opening the adjustable orifice. The method may include extending the first steering blade with a first extension force. The method may include opening the adjustable orifice. The method may include extending the first steering blade with a second extension force, the second extension force being higher than the first extension force The present disclosure provides for a method. The method may include providing a downhole tool. The downhole tool may include a housing rotatably coupled to and positioned about a mandrel. The downhole tool may include a first steering blade positioned on the housing. The first steering blade may be extendable by an extension force to contact a wellbore, the extension force caused by a first differential pressure between a first steering cylinder and a pressure in a surrounding wellbore. The first differential pressure may be caused by fluid pressure of a fluid within the first steering cylinder. The first steering cylinder may be within the housing. The first steering blade may be at least partially positioned within the first steering cylinder. The first steering cylinder may be fluidly coupled to a steering port. The downhole tool may include a first adjustable orifice. The first adjustable orifice may be fluidly coupled between an interior of the mandrel and the first steering cylinder. The first adjustable orifice may be adjustable between an open position and at least one of a partially open position and a closed position. The first adjustable orifice may be a manifold orifice of a ring valve. The ring valve may include a manifold. The manifold orifice may be formed in an upper manifold surface of the manifold. The manifold orifice may be coupled to the steering port. The ring valve may include a valve ring. The valve ring may have a lower ring surface positioned in abutment with the upper manifold surface. The valve ring may have a slot formed in the lower ring surface. The valve ring may be rotatable relative to the manifold. The method may include opening the first adjustable orifice by rotating the valve ring to a position such that the slot is aligned with the manifold orifice. The method may include extending the first steering blade with a second extension force.

The present disclosure also provides for a method of transmitting data from a downhole tool. The method may include positioning the downhole tool in a wellbore. The downhole tool may include a housing rotatably coupled to and positioned about a mandrel. The downhole tool may include a steering blade positioned on the housing. The steering blade may be extendable by an extension force to contact a wellbore, the extension force caused by a differential pressure between a steering cylinder and a pressure in a surrounding wellbore. The differential pressure may be caused by fluid pressure of a fluid within the steering cylinder. The steering cylinder may be within the housing. The steering blade may be at least partially positioned within the steering cylinder. The steering cylinder may be fluidly coupled to a steering port. The downhole tool may include an adjustable orifice. The adjustable orifice may be fluidly coupled between the interior of the mandrel and the steering cylinder. The adjustable orifice may be adjustable between an open position and one or more of a partially open position and a closed position. The method may include generating one or more pressure pulses by selectively adjusting the adjustable orifice between the open and partially open position, between the open and closed position, or between the partially open and closed position.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
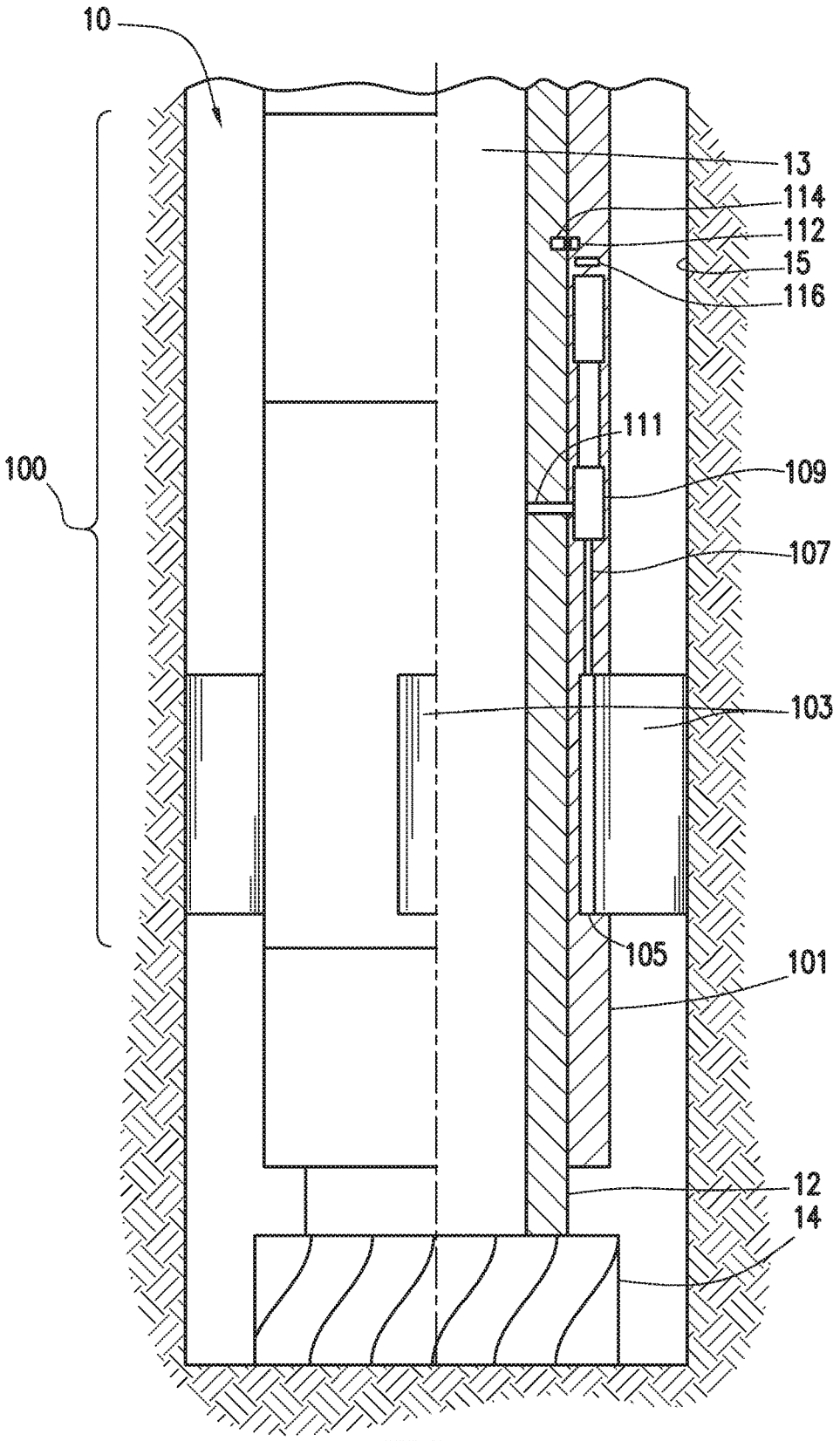
FIG. 1 depicts a schematic view of a downhole tool in partial cross section consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

As depicted in FIG. 1, downhole steering tool 100 may be included as part of drill string 10. In some embodiments, downhole steering tool 100 may be included as part of a bottomhole assembly of drill string 10. In some embodiments, downhole steering tool 100 may be positioned about mandrel 12 of drill string 10. Mandrel 12 may be coupled to drill bit 14 and adapted to provide rotational force thereto to form wellbore 15. In some embodiments, mandrel 12 may be coupled to drill string 10 such that rotation of drill string 10 from the surface by, for example and without limitation, a rotary table or top drive, causes rotation of mandrel 12. In some embodiments, mandrel 12 may be coupled to a downhole motor such as a mud motor or downhole turbine (not shown) to provide rotation. Downhole steering tool 100 may include housing 101. In some embodiments, housing 101 may be tubular or generally tubular. Housing 101 may be positioned about mandrel 12 and may be rotatably coupled thereto such that mandrel 12 may rotate independently of housing 101. In some embodiments, for example and without limitation, one or more bearings may be positioned between housing 101 and mandrel 12. Although shown as a single piece, one having ordinary skill in the art with the benefit of this disclosure will understand that housing 101 may be formed from one or more pieces.

In some embodiments, housing 101 may rotate at a speed that is less than the rotation rate of the drill bit and mandrel 12. For example and without limitation, in some embodiments, housing 101 may rotate at a speed that is less than the rotation speed of mandrel 12. For example and without limitation, housing 101 may rotate at a speed at least 50 RPM slower than mandrel 12. For example and without limitation, in an instance where mandrel 12 rotates at 51 RPM, housing 101 may rotate at 1 RPM or less. In some embodiments, housing 101 may rotate at a speed that is less than a percentage of the rotation speed of mandrel 12. For example and without limitation, housing 101 may rotate at a speed lower than 50% of the speed of mandrel 12. In some embodiments, housing 101, by not rotating, may maintain a toolface orientation independent of rotation of drill string 10.

In some embodiments, downhole steering tool 100 may include one or more steering blades 103. Steering blades 103 may be positioned about a periphery of housing 101. Steering blades 103 may be extendible to contact wellbore 15. In some embodiments, steering blades 103 may be at least partially positioned within steering cylinders 105 and may be sealed thereto. Fluid pressure within each steering cylinder 105 may increase above fluid pressure in the surrounding wellbore 15, thereby causing a differential pressure across the steering blade 103 positioned therein. The differential pressure may cause an extension force on steering blade 103. The extension force on steering blade 103 may urge steering blade 103 into an extended position. When positioned within wellbore 15, the extension force may cause steering blade 103 to contact wellbore 15. In some embodiments, steering blade 103 may, for example and without limitation, at least partially prevent or retard rotation of housing 101 to, for example and without limitation, less than 20 revolutions per hour.

In some embodiments, fluid may be supplied to each steering cylinder 105 through a steering port 107. In some embodiments, the fluid may be drilling mud. The fluid in each steering port 107 may be controlled by one or more adjustable orifices 109. Fluids may include, but are not limited to, drilling mud, such as oil-based drilling mud or water-based drilling mud, air, mist, foam, water, oil, including gear oil, hydraulic fluid or other fluids within wellbore 15. Adjustable orifices 109 may control fluid flow between an interior of mandrel 12 and steering ports 107. In some embodiments, each steering cylinder 105 is controlled by an adjustable orifice 109. In some embodiments, one or more steering blades 103 may be aligned about downhole steering tool 100 and may be controlled by the same adjustable orifice 109. As used herein, "adjustable orifice" includes any valve or mechanism having an adjustable flow rate or restriction to flow.

Fluid may be supplied to each adjustable orifice 109 from an interior 13 of mandrel 12. Adjustable orifice 109 may be fluidly coupled to the interior 13 of mandrel 12. In some embodiments, for example and without limitation, one or more apertures 111 may be formed in mandrel 12 which may be coupled to each adjustable orifice 109 allowing fluid to flow to each adjustable orifice 109 as mandrel 12 rotates relative to housing 101. In some embodiments, as further discussed herein below, a diverter may be utilized.

Figure 2A:
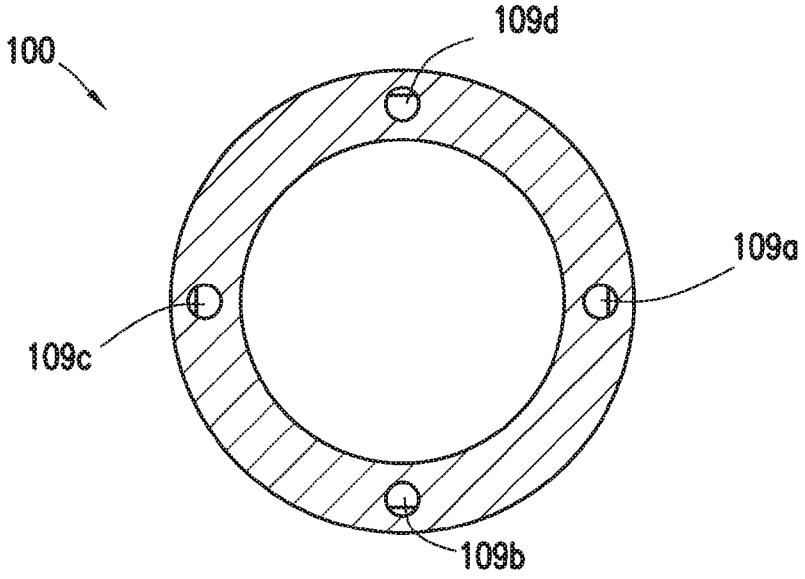
FIGS. 2A, 2B depict schematic cross sections of the downhole tool of FIG. 1 in a centralizing position.
Figure 2B:
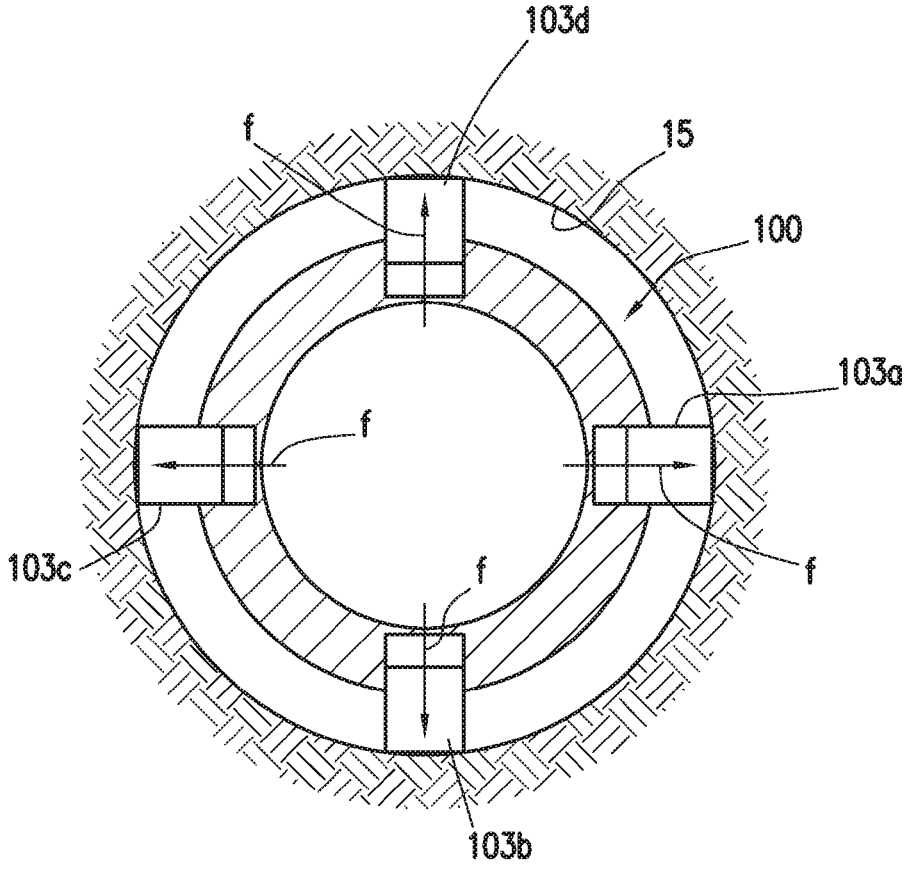

In some embodiments, adjustable orifices 109 may be reconfigurable between an open position and a partially open position. In some embodiments, adjustable orifices 109 may further have a closed position. In the partially open position, adjustable orifices 109 may remain partially open such that an amount of fluid may pass into the corresponding steering cylinder 105. During certain operations, for instance to centralize downhole steering tool 100 within wellbore 15, as depicted schematically and without limitation as to structure in FIG. 2A, each adjustable orifice 109*a-d* may remain in the partially open position, such that only a portion of the amount of fluid may pass therethrough compared to when an adjustable orifice 109 is fully open. In some embodiments, the partially open position may allow between 0% and 50% of the flow of the opened position, between 10% and 40% of the flow of the opened position, or between 25% and 35% of the opened position. Each steering blade 103*a-d* may thus receive a substantially equal differential pressure thereacross and may be extended to contact wellbore 15 with approximately equal extension force, shown graphically as arrows depicting first extension force f. Steering blades 103*a-d* may thus centralize downhole steering tool 100 within wellbore 15. In some embodiments, steering blades 103*a-d* may include one or more anti-rotation features (not shown) on the end thereof such that when in contact with wellbore 15, the force exerted by each steering blade 103*a-d* prevents or retards rotation of downhole steering tool 100 relative to wellbore 15.

Figure 3A:
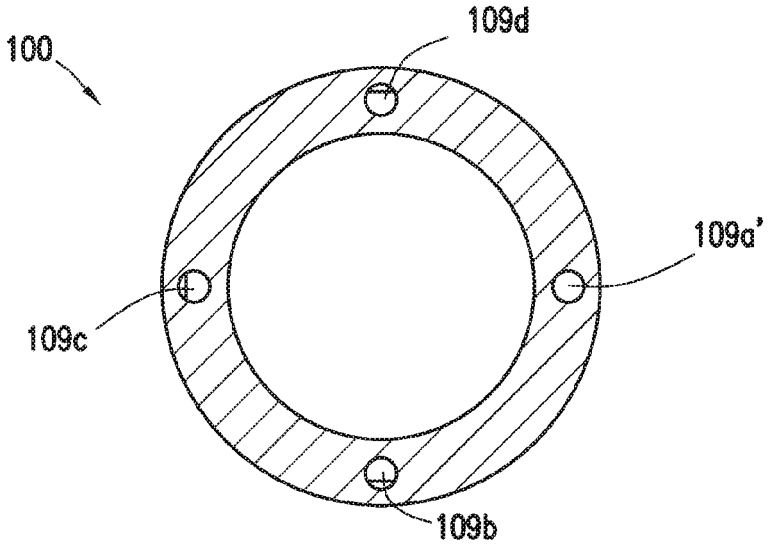
FIGS. 3A, 3B depict schematic cross sections of the downhole tool of FIG. 1 in a steering position.
Figure 3B:
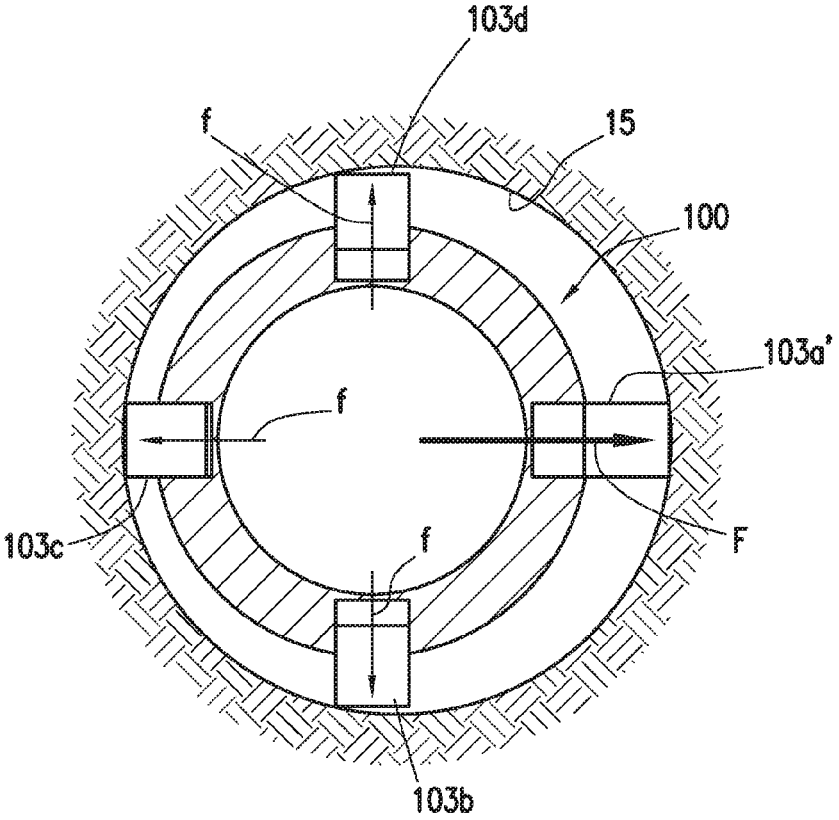

When a steering input is desired, one or more adjustable orifices (depicted as adjustable orifice 109*a*' in FIG. 3A), may be fully opened by actuating its corresponding solenoid (not shown). The adjustable orifices 109*b-d* not in the open position may remain in the partially open position. With adjustable orifice 109*a*' in the open position, a larger amount of fluid may flow to the corresponding steering blade (103*a*' in FIG. 3B), causing the differential pressure thereacross to be higher than to steering blades 103 not corresponding to a fully open adjustable orifice 109, and thus exerting a larger extension force, depicted as second extension force F thereupon. The opposing steering blade (here 103*c*) (or steering blades depending on configuration) receives a smaller first extension force f, and its extension may be at least partially overcome by the extension of steering blade 103*a*', causing downhole steering tool 100 to be pushed away from wellbore 15 in the direction of steering blade 103*a*'. This second extension force F may thus cause a change in the direction in which steering tool 100 is pushed relative to wellbore 15, referred to herein as a force-vector direction, which may alter the direction in which wellbore 15 is drilled.

In some embodiments, when drilling a straight or nearly straight wellbore 15, in some embodiments, all adjustable orifices 109*a-d* may be opened, applying substantially equal pressure to all steering blades 103, causing equal force exerted by all steering blades 103 against wellbore 15. Alternatively, minimum gripping force may be exerted by all steering blades 103 against wellbore 15 when all adjustable orifices 109*a-d* are partially open.

Figure 4:
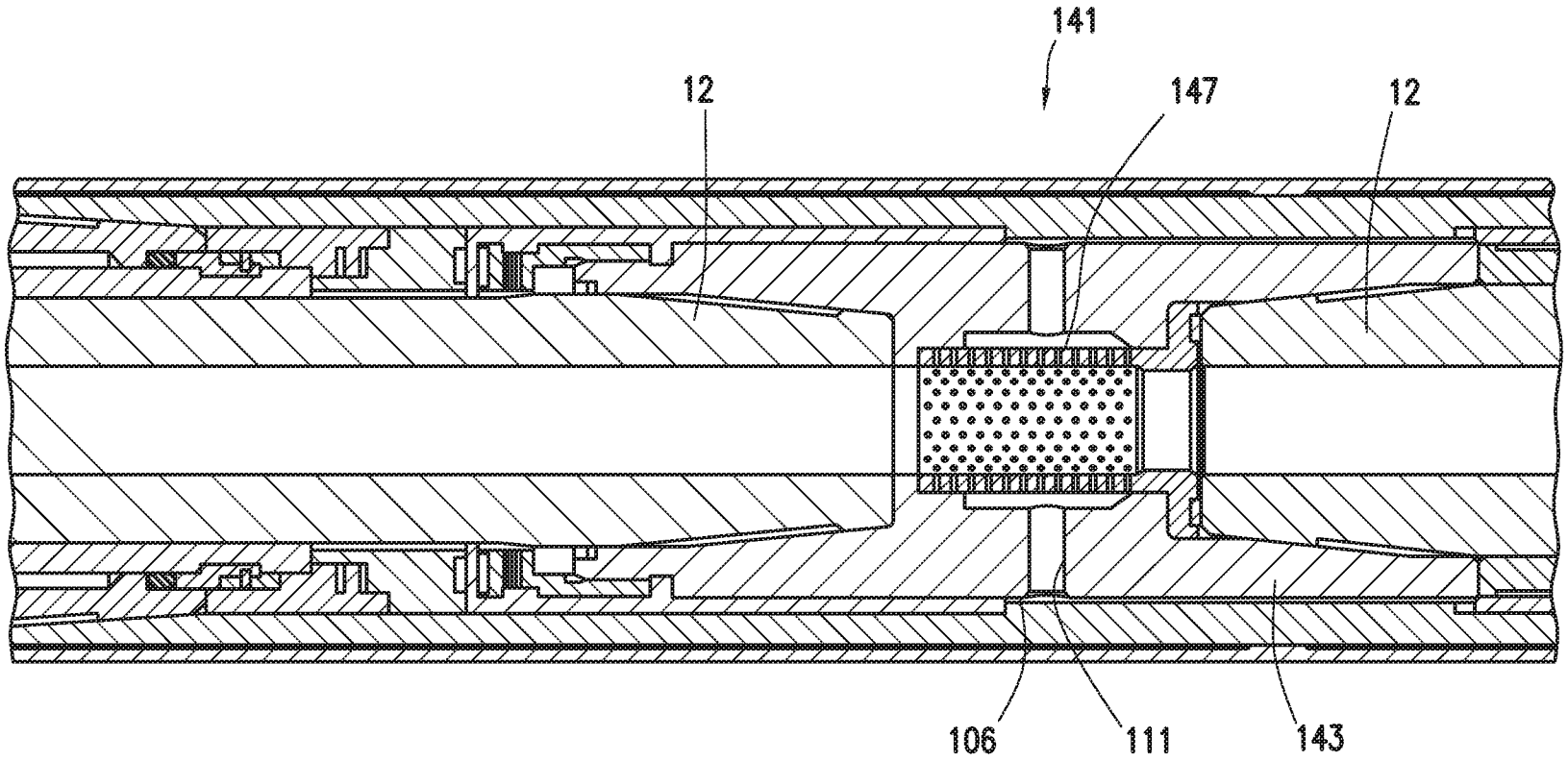
FIG. 4 depicts a cross section view of a diverter of a downhole tool consistent with at least one embodiment of the present disclosure.

In some embodiments, as depicted in FIG. 4, fluid may be supplied from the interior of mandrel 12 (here depicted as having two subcomponents coupled to either side of diverter assembly 141) through diverter assembly 141. The fluid within mandrel 12 may include, without limitation, drilling mud, such as oil-based drilling mud or water-based drilling mud; air; mist; foam; water; oil, including gear oil; hydraulic fluid; or a combination thereof. The fluid within mandrel 12 may be supplied by one or more pumps (not shown) at the surface through mandrel 12 to, for example and without limitation, operate one or more downhole tools and clear cuttings from wellbore 15 during a drilling operation. Fluid within mandrel 12 may be at a higher pressure than fluid within wellbore 15. Diverter assembly 141 may include diverter body 143 coupled to and rotatable with mandrel 12. In some embodiments, diverter assembly 141 may be formed integrally with mandrel 12. In some embodiments, diverter assembly 141 may contain drilling fluid filter 147. Diverter body 143 may include one or more apertures 111 coupling the interior of mandrel 12 to one or more fluid supply ports 106 formed within housing 101. Fluid supply ports 106 may supply fluid to adjustable orifices as described herein below. In some embodiments, approximately 4-5% of the flow going through the interior of mandrel 12 may be diverted through diverter assembly 141. In some embodiments, a portion of the diverted fluid may pass into one or more bearings (not shown) and may exit to the annular space about downhole steering tool 100.

In some embodiments, a controller, discussed herein below as controllers 119 and 237 shown in FIGS. 5A, 6A respectively, may control the actuation of adjustable orifices 109. For the purpose of this description, controller 119 will be discussed specifically, although one having ordinary skill in the art with the benefit of this disclosure will understand that controller 237 may operate similarly. In some embodiments, controller 119 may be electrically coupled to adjustable orifices 109.

In some embodiments, controller 119 may include one or more microcontrollers, microprocessors, FPGAs (field programmable gate arrays), a combination of analog devices, such analog integrated circuits (ICs), or any other devices known in the art. In some embodiments, downhole steering tool 100 may include differential rotation sensor 112, which may be operable to measure a difference in rotation rates between mandrel 12 and housing 101, and housing rotation measurement device or sensor 116, which may be operable to measure a rotation rate of housing 101. For example, in some embodiments, differential rotation sensor 112 may include one or more infrared sensors, ultrasonic sensors, Hall-effect sensors, fluxgate magnetometers, magneto-resistive magnetic-field sensors, micro-electro-mechanical system (MEMS) magnetometers, and/or pick-up coils. Differential rotation sensor 112 may interact with one or more markers 114, such as infrared reflection mirrors, ultrasonic reflectors, magnetic markers, permanent magnets, electro magnets, coupled to mandrel 12 which may be, for example and without limitation, one or more magnets or electromagnets to interact with a magnetic differential rotation sensor 112. Housing rotation measurement device or sensor 116 may include one or more accelerometers, magnetometers, and/or gyroscopic sensors, including micro-electro-mechanical system (MEMS) gyros, MEMS accelerometers and/or others operable to measure cross-axial acceleration, magnetic-field components, or a combination thereof. Gyroscopic sensors and/or MEMS gyros may be used to measure the rotation speed of housing 101 and irregular rotation speed of housing 101, such as torsional oscillation and stick-slip. The accelerometers and magnetometers in housing 101 may be used to calculate the toolface of downhole steering tool 100. The toolface of downhole steering tool 100 may, in some embodiments, be referenced to a particular steering blade 103. In some embodiments, the toolface of downhole steering tool 100 may be defined relative to a gravity field, known as a gravity toolface; defined relative to a magnetic field, known as a magnetic toolface; or a combination thereof. Differential rotation sensors 112 and housing rotation measurement device or sensors 116 may be disposed anywhere in the housing 101. Markers 114 may be disposed to the corresponding position on mandrel 12, substantially near differential rotation sensors 112.

Figure 8:
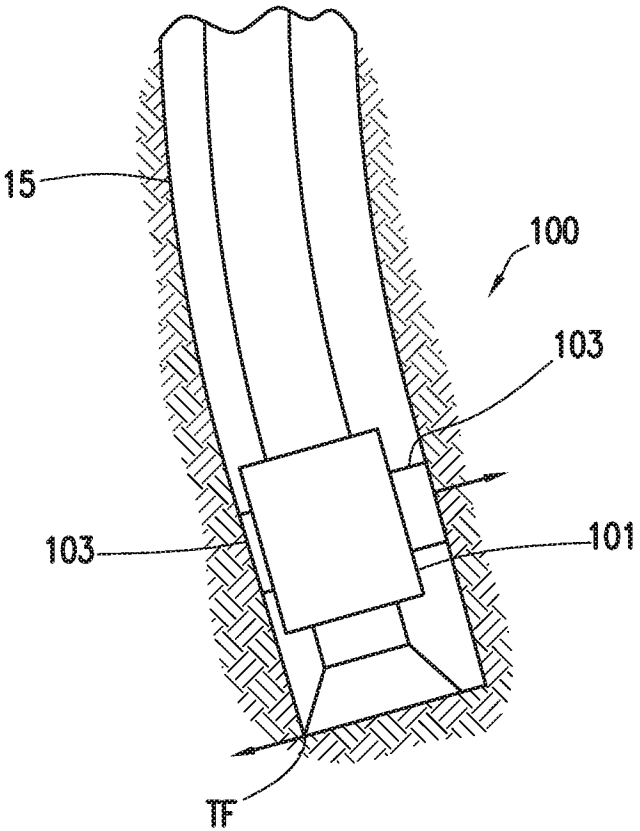
FIG. 8 depicts a cross section of a downhole tool consistent with at least one embodiment of the present disclosure.

When drilling a vertical wellbore 15, as depicted in FIG. 8, gravity toolface may be used. To maintain verticality, gravity toolface (GTF) may be set to the low side of wellbore 15, corresponding to a 180° gravity toolface, and at least one steering blade 103 may apply an eccentric force to the side of wellbore 15 opposite the target toolface (TF). In some embodiments, the steering blade 103 may apply an eccentric force to the side of wellbore 15 substantially opposite the target TF, such as, for example and without limitation, within 15° of 180° from the target TF.

In some embodiments, in order to drill wellbore 15 vertically, the target gravity tool face (GTF) of downhole steering tool 100 may be set to the low side of the borehole (GTF=180°). In some embodiments, the equation for the GTF may be given by:

$$GTF = \arctan\left(\frac{G_y}{G_x}\right).$$

The accuracy of GTF near vertical may depend on the accuracy of the transverse acceleration measurements (Gx and Gy).

Figure 9:
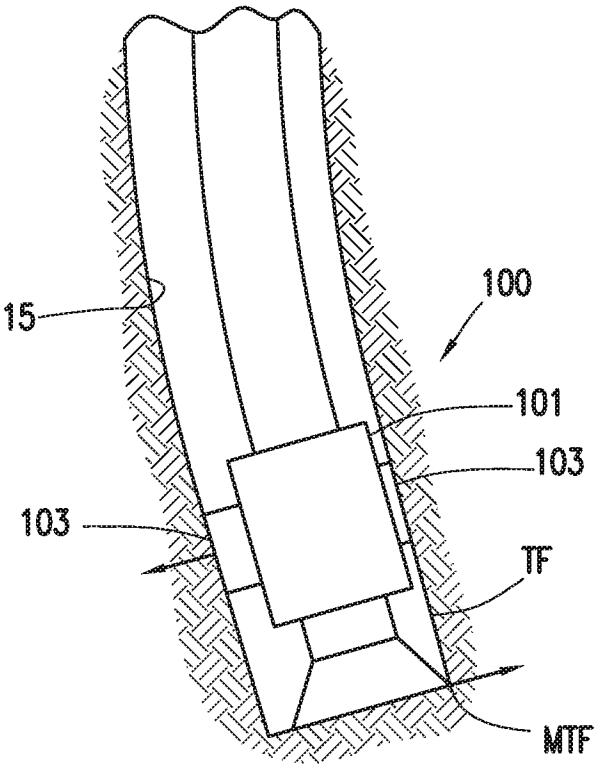
FIG. 9 depicts a cross section of a downhole tool consistent with at least one embodiment of the present disclosure.

To form a deviated wellbore, the initial change in direction of wellbore 15, referred to herein as a kick-off from vertical, as depicted in FIG. 9, may be defined with respect to a magnetic toolface. In some embodiments, at least one steering blade 103 may apply an eccentric force to the opposite side of the target toolface against wellbore 15.

In some embodiments, when vertical or, for example and without limitation, within 5° to 10° of vertical, a magnetic toolface may be used. Above, for example and without limitation, 5° to 10° of inclination, a gravity toolface may be utilized.

In some embodiments, in vertical kick-off, magnetic toolface (MTF) may be used to kick off to the desired direction (e.g. referenced to magnetic field, such as north, south, east, west or magnetic toolface to be zero, referencing to the magnetic north). The equation for the MTF may be given by:

$$MTF = \arctan\left(\frac{M_y}{M_x}\right)$$

Figure 10A:
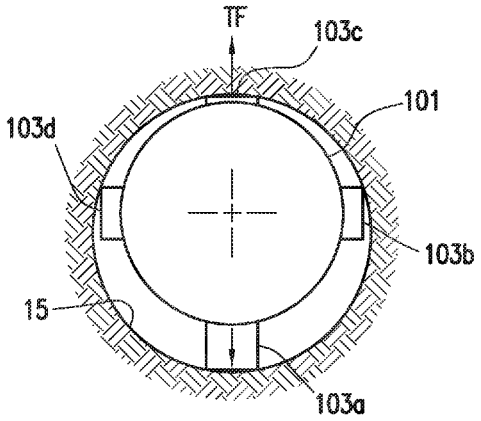
FIGS. 10A-D depict schematic cross sections of a downhole tool consistent with at least one embodiment of the present disclosure in various rotational positions.
Figure 10B:
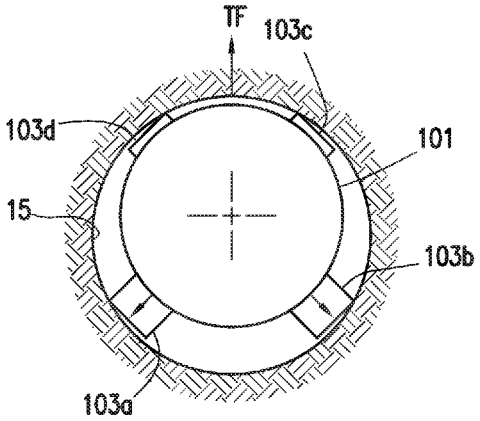
Figure 10C:
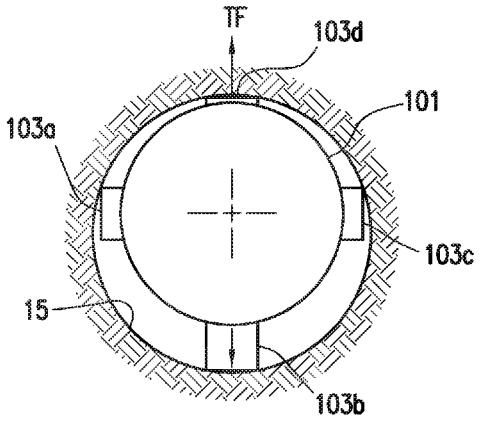
Figure 10D:
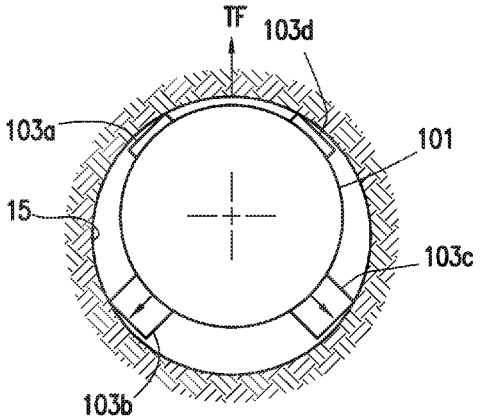

In some embodiments, as housing 101 rotates, the steering blade or blades 103 aligned substantially opposite of the target toolface changes. Controller 119 may be configured to actuate either one or two adjacent steering blades 103 to apply an eccentric steering force on wellbore 15 to push downhole steering tool 100 in a desired direction corresponding with the target toolface. In some embodiments, the steering blades 103 not actuated by controller 119 may be extended to provide gripping pressure as they are in the partially open position. For example and without limitation, as depicted in FIGS. 10A-D, as housing 101 rotates substantially slowly, e.g. one revolution per hour, steering blades 103*a-d*, as they rotate relative to wellbore 15, are sequentially actuated when oriented opposite the target toolface (TF). In FIG. 10A, steering blade 103*a* is actuated. In FIG. 10B, after housing 101 rotates, steering blades 103*a* and 103*b* are actuated. In FIG. 10C, steering blade 103*b* alone is actuated, and in FIG. 10D, steering blades 103*b* and 103*c* are actuated.

In some embodiments, the target toolface (either MTF or GTF) may be downlinked to downhole steering tool 100. In some embodiments, the target toolface may be computed based on the target inclination or target inclination/azimuth downlinked to downhole steering tool 100. In some such embodiments, controller 119 may use a closed-loop control system for inclination/azimuth hold.

Figure 5A:
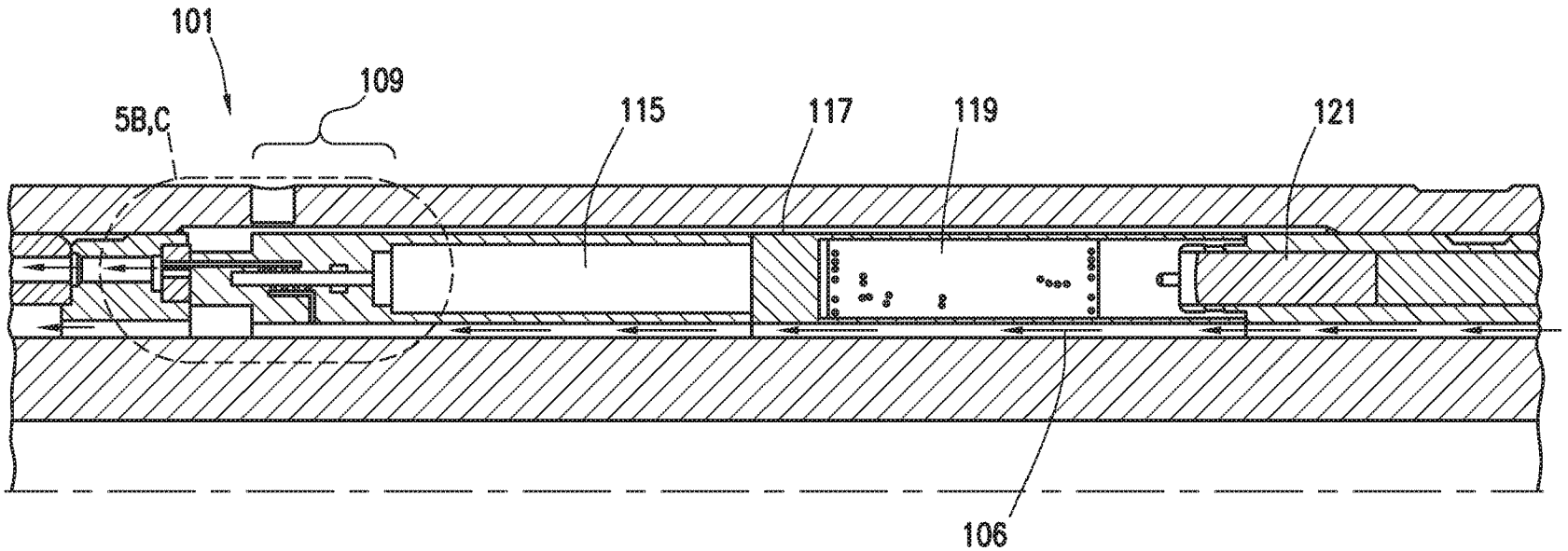
FIG. 5A depicts a partial cross section view of a downhole tool consistent with at least one embodiment of the present disclosure.

In some embodiments, as depicted in FIG. 5A, each adjustable orifice 109 may be controlled by a corresponding solenoid actuator, referred to herein as solenoid 115. In some embodiments, each solenoid 115 may be positioned within compensated oil compartment 117. Compensated oil compartment 117 may be filled with a fluid such as an oil and prevent or restrict drilling fluid or other debris from entering compensated oil compartment 117. In some embodiments, compensated oil compartment 117 may be pressurized to a pressure higher than that expected of the surrounding fluid.

In some embodiments, solenoids 115 may be controlled by controller 119. In some embodiments, controller 119 may be electrically coupled to solenoids 115, and may include electronics configured to actuate solenoids 115. In some embodiments, controller 119 may include or be electrically coupled to one or more sensors, such as, for example and without limitation, accelerometers, gyroscopes, magnetometers, etc., and may use information detected by the one or more sensors to control solenoids 115. In some embodiments, controller 119 may include electronics for receiving instructions for controlling solenoids 115. In some embodiments, controller 119 may include one or more power supplies, such as, for example and without limitation, batteries 121, for powering controller 119 and solenoids 115. Solenoids 115 may be coupled to adjustable orifices 109 by one or more mechanical linkages. Solenoids 115 may be any type of solenoid known in the art, including, for example and without limitation, push solenoids, pull solenoids, rotary solenoids, and latching solenoids.

Figure 5B:
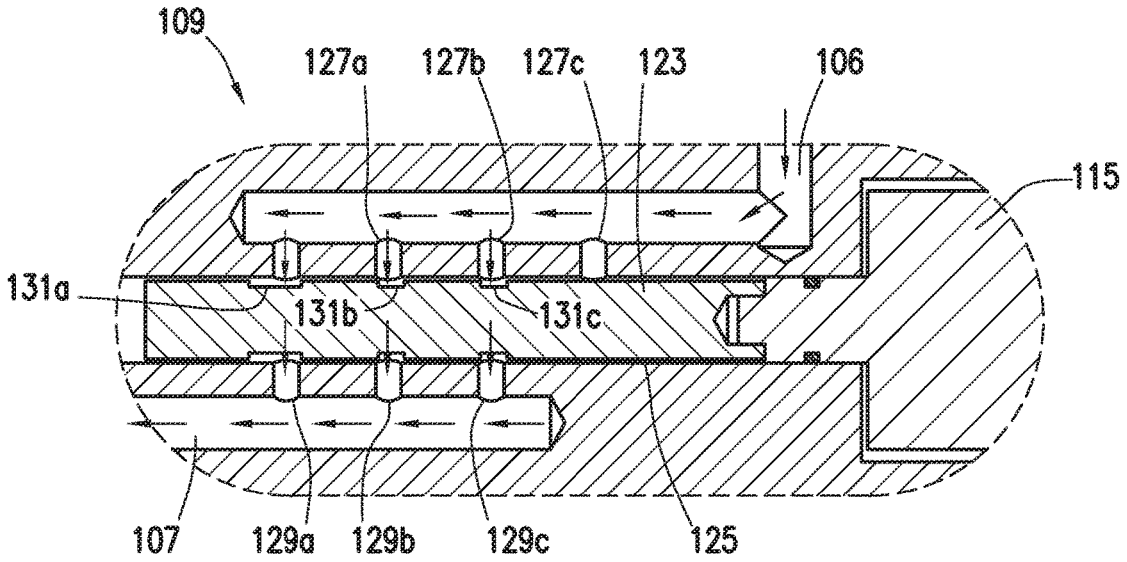
FIG. 5B depicts a detail view of the downhole tool of FIG. 5A in an open position.
Figure 5C:
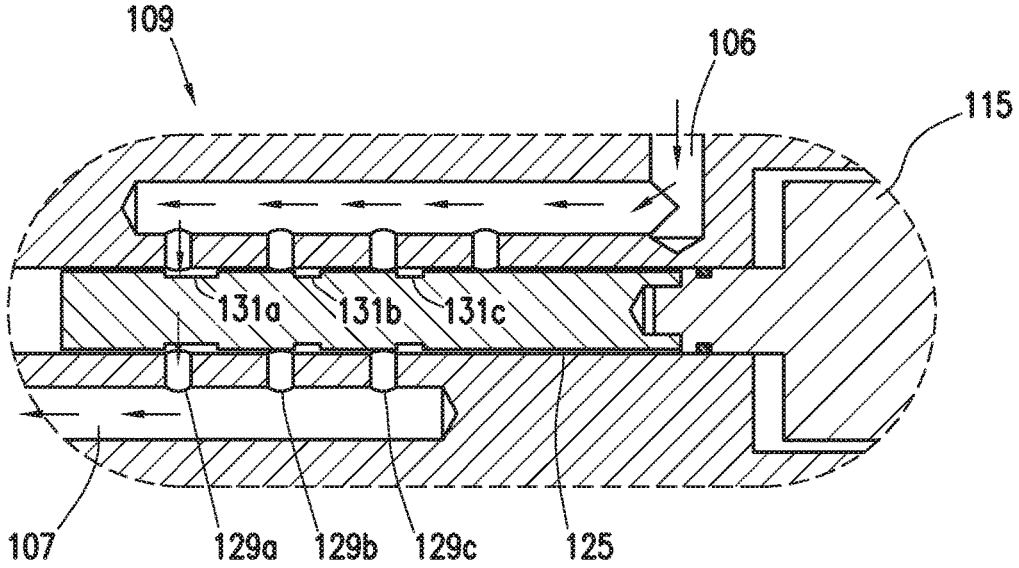
FIG. 5C depicts a detail view of the downhole tool of FIG. 5A in a partially open position.

In some embodiments, as depicted in FIG. 5B, 5C, solenoid 115 may be coupled to piston 123. Piston 123 may be movable by solenoid 115, here depicted as a linear push solenoid although other solenoids are encompassed by this disclosure. Piston 123 may be positioned within valve cylinder 125. Valve cylinder 125 may include two or more input ports 127*a-c* that are fluidly coupled with fluid supply ports 106 as discussed herein above in fluid communication with the interior of mandrel 12. Valve cylinder 125 may also include output ports 129*a-c* that are fluidly coupled to steering port 107. In some embodiments, input ports 127*a-c* may be aligned with output ports 129*a-c*. In some embodiments, piston 123 may include one or more radial grooves 131*a-c*. Radial grooves 131*a-c* may fluidly couple corresponding input ports 127*a-c* and output ports 129*a-d* when the corresponding radial groove 131*a-c* is aligned therewith as depicted in FIG. 5B (the "open" position), and close fluid communication therebetween when not aligned therewith by movement of piston 123 by solenoid 115 as depicted in FIG. 5C (the "partially open" position). In some embodiments, one or more of radial grooves 131*a-c* (here depicted as radial groove 131*a*) may be of a sufficient width such that fluid communication between the corresponding ports, here input port 127*a* and output port 129*a*, is open when piston 123 is in the partially open position, as depicted in FIG. 5C where radial groove 131*a* is wider than radial grooves 131*b-c*. In such an embodiment, when in the open position, i.e. adjustable orifice 109 is open, more fluid is able to flow through than when in the partially open position, i.e. adjustable orifice 109 is partially open, as all input ports 127*a-c* are fluidly coupled to output ports 129*a-c*, rather than only one input port 127*a* to output port 129*a* in the partially open position. One having ordinary skill in the art with the benefit of this disclosure will understand that any number of input ports and output ports may be utilized without deviating from the scope of this disclosure, and any number of ports may remain fluidly coupled in the closed position without deviating from the scope of this disclosure. In some embodiments, the number of ports may be selected such that the force required to actuate solenoid 115 is within a desired limit.

Figure 6A:
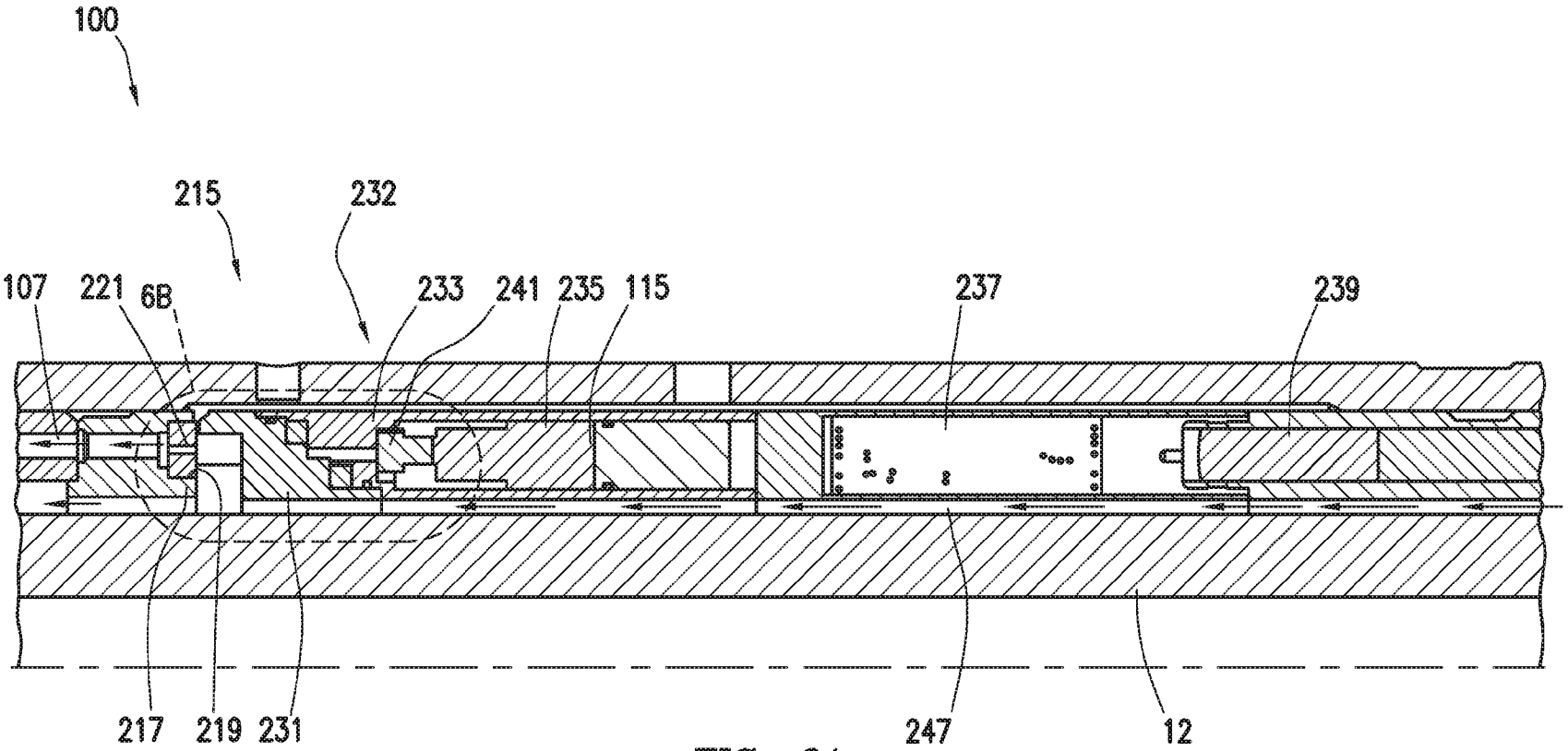
FIG. 6A depicts a partial cross section view of a downhole tool consistent with at least one embodiment of the present disclosure.
Figure 6B:
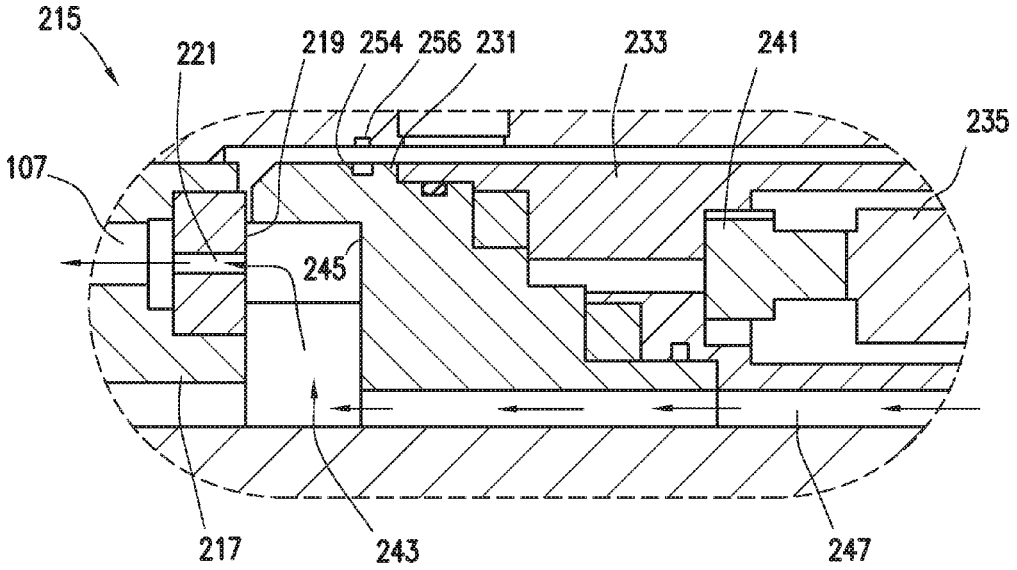
FIG. 6B depicts a detail view of the downhole tool of FIG. 6A.
Figure 6C:
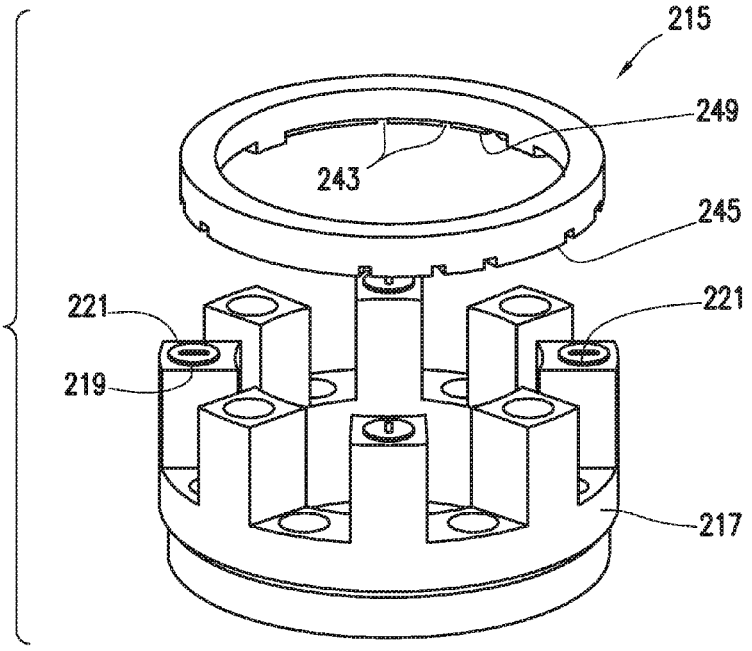
FIG. 6C depicts a perspective view of components of the downhole tool of FIG. 6A.

In some embodiments, as depicted in FIGS. 6A-C, adjustable orifices 109' may be controlled by ring valve 215. Ring valve 215, may include manifold 217 and valve ring 231. Manifold 217 may include adjustable orifices 109' defining manifold orifices 221 arranged about upper manifold surface 219. Each manifold orifice 221 may be coupled to a corresponding steering port 107. Fluids controlled by ring valve 215 may include, but are not limited to, drilling mud, such as oil-based drilling mud or water-based drilling mud, air, mist, foam, water, oil, including gear oil, hydraulic fluid or other fluids within mandrel 12.

Valve ring 231 may be generally annular. Valve ring 231 may be rotated by one or more motors 235. In some embodiments, motor 235 may be an electric motor, such as, for example and without limitation, a brushless DC (direct current) motor. In some embodiments, motor 235 may be controlled by controller 237. In some embodiments, controller 237 may include electronics configured to actuate motor 235. In some embodiments, controller 237 may include one or more sensors, such as, for example and without limitation, accelerometers, gyroscopes, magnetometers, etc., and may use information detected by the one or more sensors to control motor 235. In some embodiments, valve ring 231 may include one or more position markers 254 such as magnetic markers or magnets. Controller 237 may include one or more valve ring position sensors 256 to determine the position of valve ring 231. Valve ring position sensors 256 may include, for example and without limitation, one or more pick up coils, magnetometers, Hall-effect sensors, mechanical position sensors, or optical position sensors. In some embodiments, controller 237 may include electronics for receiving instructions for controlling motor 235. In some embodiments, controller 237 may include one or more power supplies, such as, for example and without limitation, batteries 239, for powering controller 237 and motor 235. Motor 235 may be coupled to valve ring 231 by one or more mechanical linkages such as gearbox 232 which may include, for example and without limitation, drive ring 233 and pinion 241 or other linkages. In some embodiments, valve ring 231 may be coupled to or formed as part of a rotor of motor 235.

Controller 237 may include, for example and without limitation, one or more microcontrollers, microprocessors, FPGAs (field programmable gate arrays), a combination of analog devices, such analog integrated circuits (ICs), or any other devices known in the art, which may be programmed with motor controller logic and algorithms, including angular position controller logic and algorithms.

In some embodiments, valve ring 231 may include one or more slots 243 formed on lower ring surface 245 thereof (shown in FIG. 6C). Lower ring surface 245 may abut or be positioned in abutment with upper manifold surface 219 such that when a slot 243 is aligned with a manifold orifice 221 of manifold 217, fluid may flow through manifold orifice 221 from fluid supply port 247 coupled to the interior of mandrel 12 as previously discussed herein. Valve ring 231 may be rotated by motor 235, moving slots 243 into and out of alignment with adjustable orifices 109'. In some embodiments, valve ring 231 may be rotatable by one or more full revolutions. In some embodiments, slots 243 may be arranged such that valve ring 231 needs only rotate a partial turn to actuate each of adjustable orifices 109'. In some embodiments, slots 243 may be arranged about valve ring 231 such that adjustable orifices 109' opposite one another are not open at the same time. In some embodiments, slots 243 may be arranged such that adjacent adjustable orifices 109' may be opened at the same time.

In some embodiments, lip 249 may be formed in lower ring surface 245 of valve ring 231. Lip 249 may be positioned such that lower ring surface 245 of valve ring 231 partially blocks a manifold orifice 221 when aligned with lip 249 and not with slot 243, thereby partially opening the manifold orifice 221. In some embodiments, lip 249 may be discontinuous such that all manifold orifices 221 may be fully closed in a certain position of valve ring 231.

For example, FIGS. 7A-J depict an exemplary valve ring 231 (in semitransparent view) positioned manifold 217. Each drawing depicts valve ring 231 rotated to a different angular position and with slots 243 opening or closing one or more of manifold orifices 221*a-d* as outlined in the following table.

TABLE 1

Ring Valve Positions FIGS 7A-7J

| FIG # | Valve Ring Angular Position | Orifice 1 (221a) | Orifice 2 (221b) | Orifice 3 (221c) | Orifice 4 (221d) |
|---|---|---|---|---|---|
| 7A | 0° | OPEN | PARTIALLY OPEN | PARTIALLY OPEN | PARTIALLY OPEN |
| 7B | 5°* | PARTIALLY OPEN | PARTIALLY OPEN | PARTIALLY OPEN | PARTIALLY OPEN |
| 7C | 10° | OPEN | OPEN | PARTIALLY OPEN | PARTIALLY OPEN |
| 7D | 20° | PARTIALLY OPEN | OPEN | PARTIALLY OPEN | PARTIALLY OPEN |
| 7E | 30° | PARTIALLY OPEN | OPEN | OPEN | PARTIALLY OPEN |
| 7F | 40° | PARTIALLY OPEN | PARTIALLY OPEN | OPEN | PARTIALLY OPEN |
| 7G | 50° | PARTIALLY OPEN | PARTIALLY OPEN | OPEN | OPEN |
| 7H | 60° | PARTIALLY OPEN | PARTIALLY OPEN | PARTIALLY OPEN | OPEN |
| 7I | 70° | OPEN | PARTIALLY OPEN | PARTIALLY OPEN | OPEN |
| 7J | 80° | CLOSED | CLOSED | CLOSED | CLOSED |

Figure 7A:
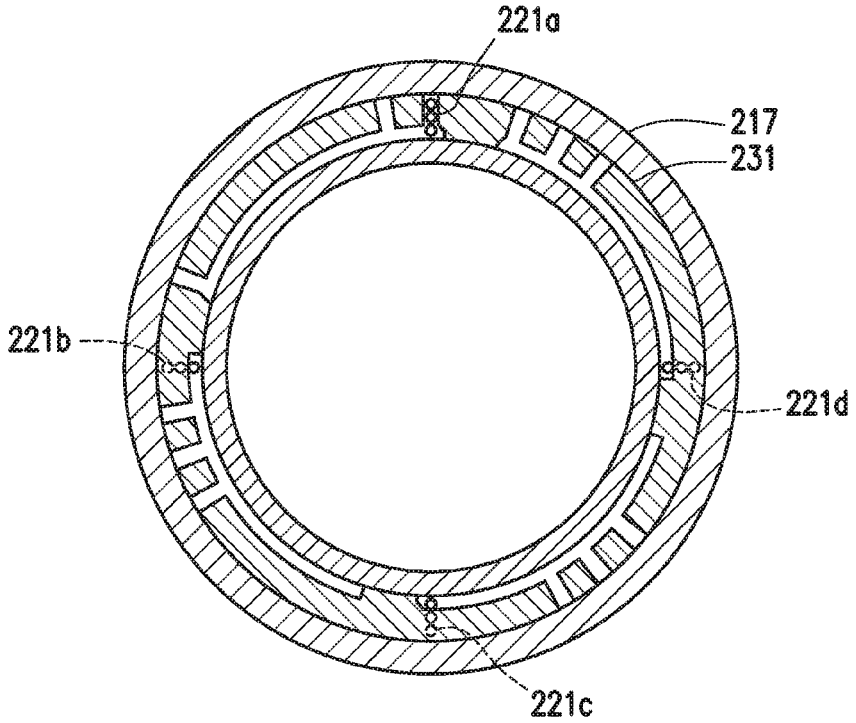
FIGS. 7A-7J depict a semitransparent view of a ring valve consistent with at least one embodiment of the present disclosure in various positions.
Figure 7B:
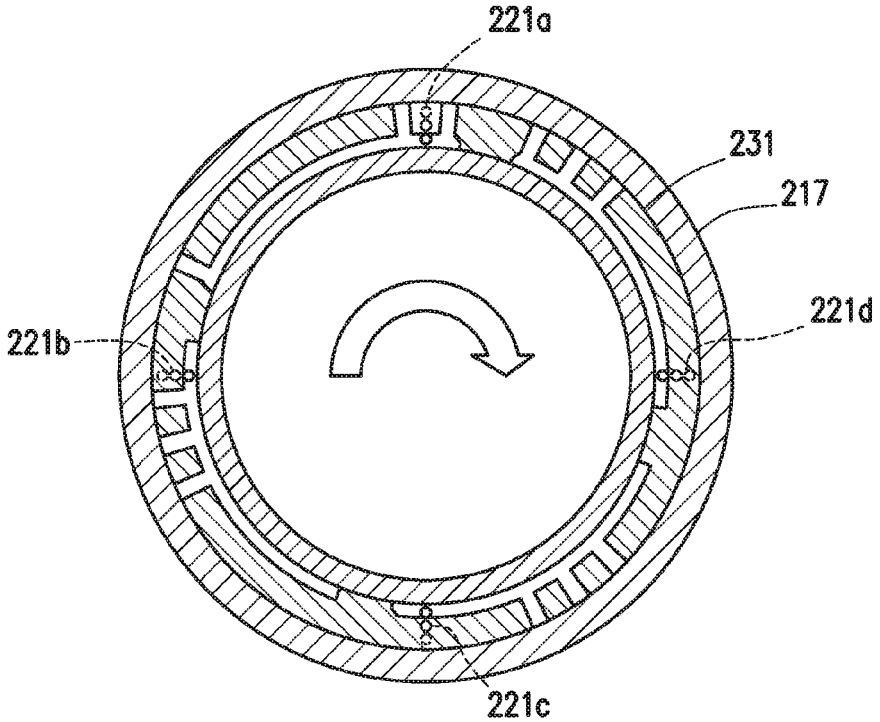
Figure 7C:
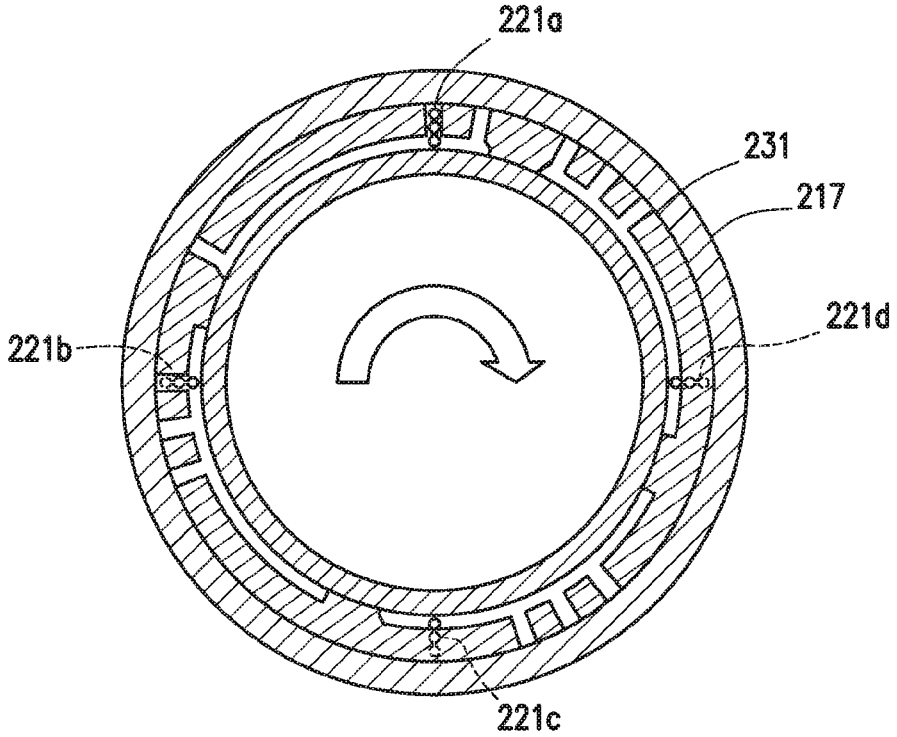
Figure 7D:
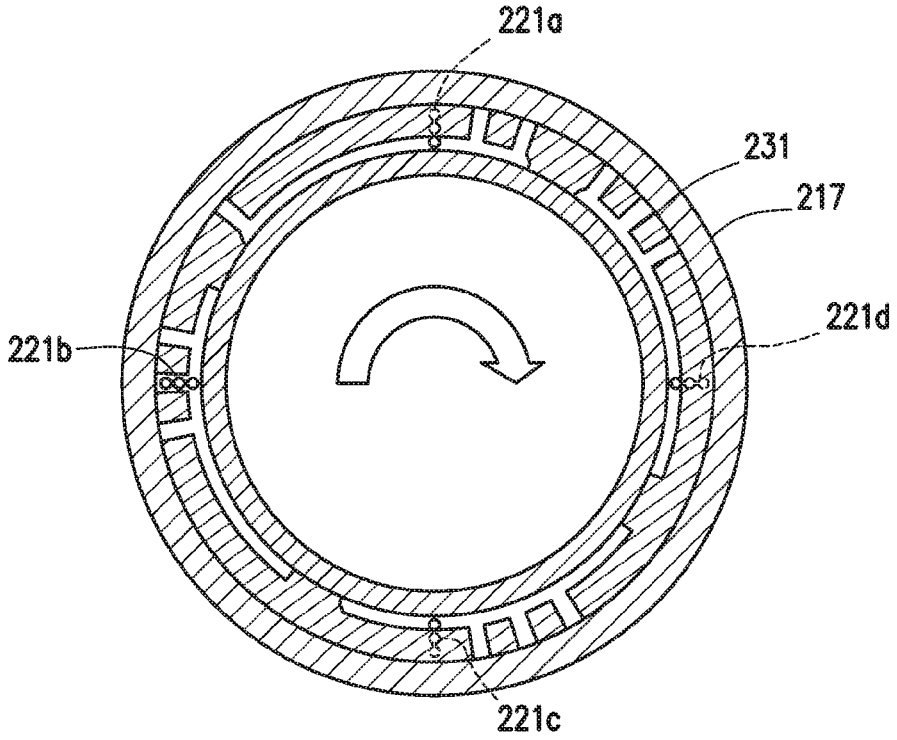
Figure 7E:
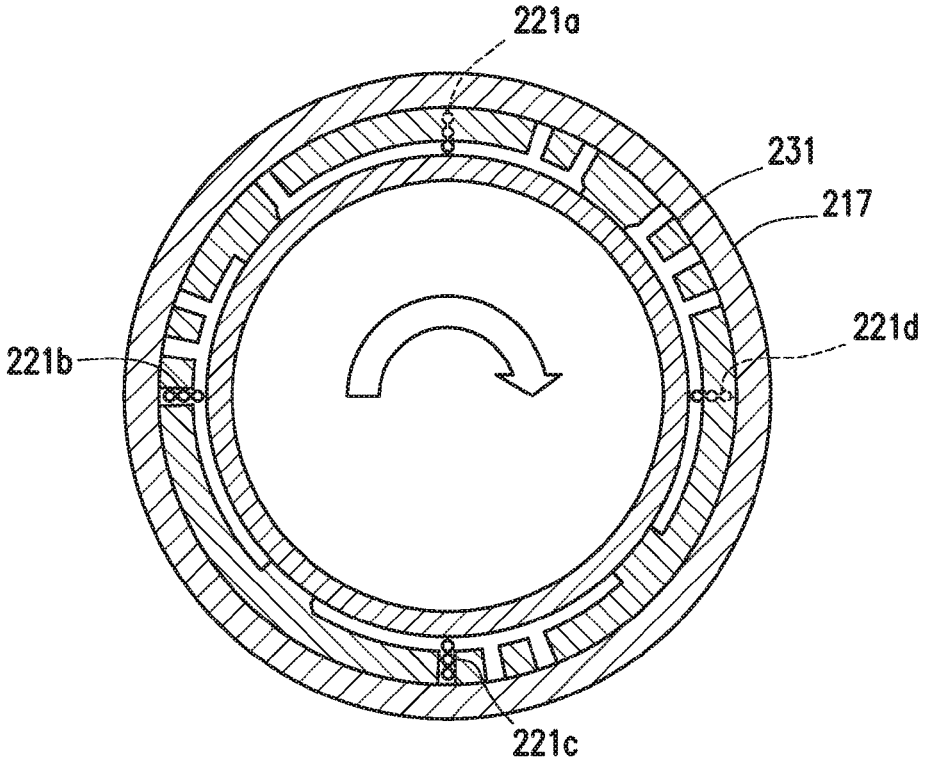
Figure 7F:
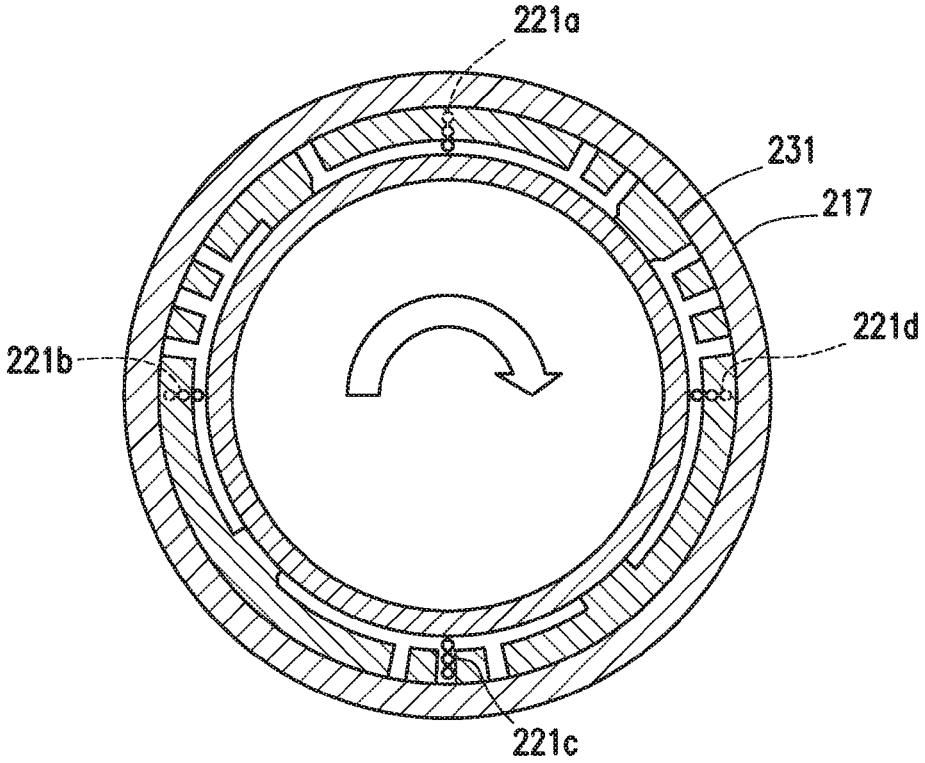
Figure 7G:
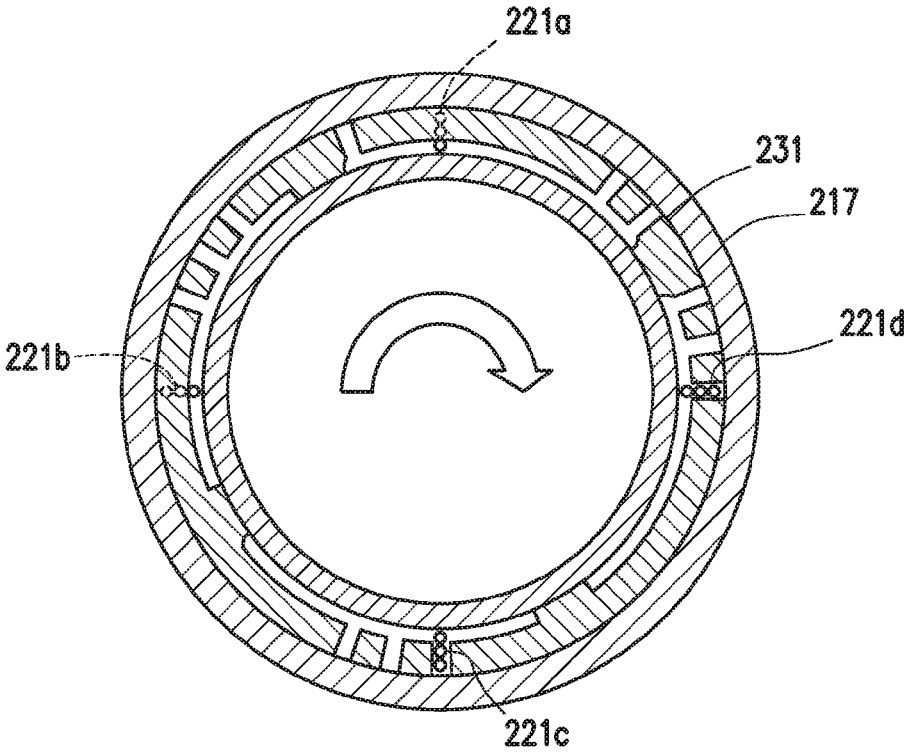
Figure 7H:
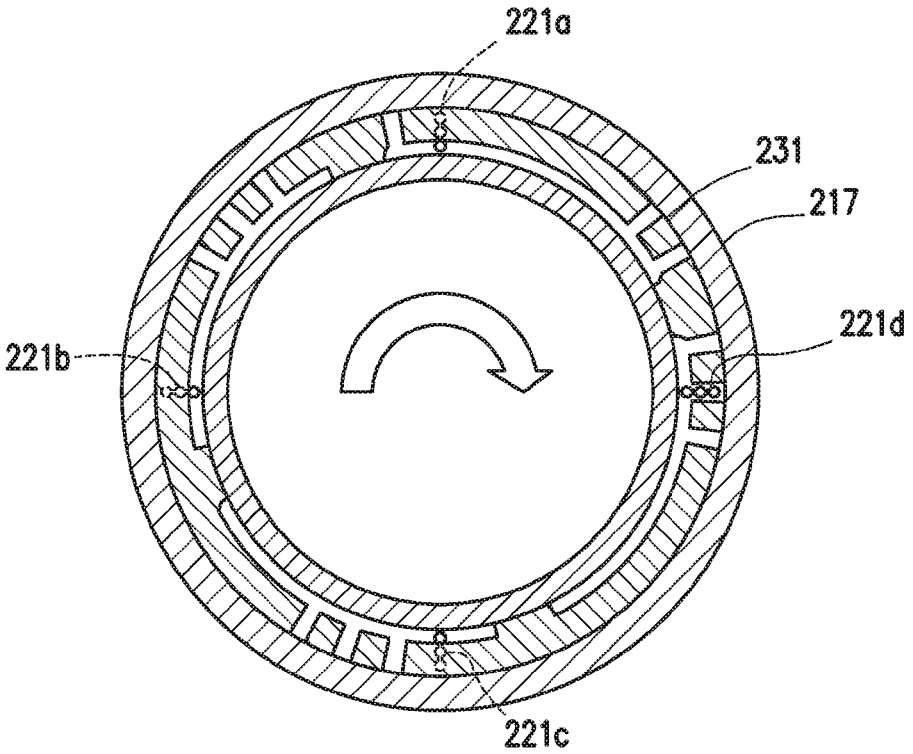
Figure 7I:
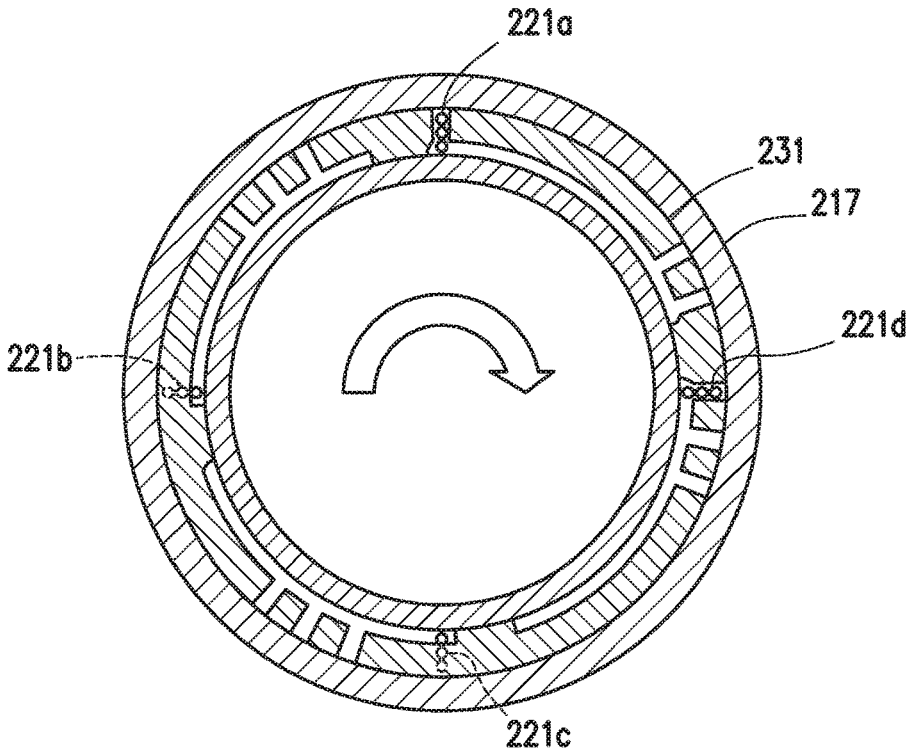
Figure 7J:
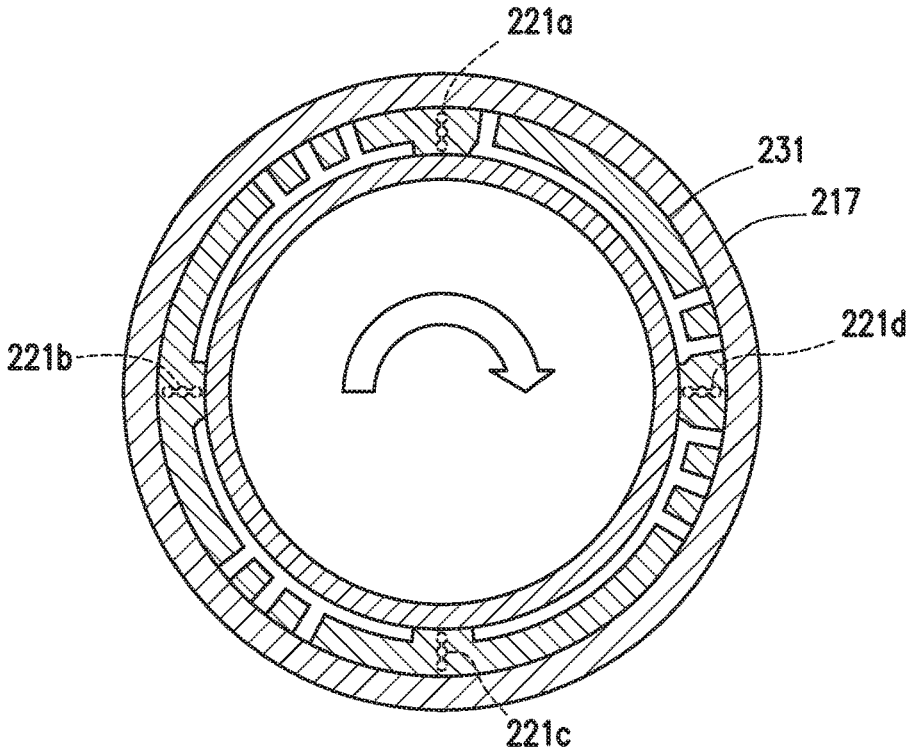

In some embodiments, although described as at a 5° offset of valve ring 231, the position shown in FIG. 7B in which each manifold orifice 221*a-d* is partially closed may be between any of the other positions, such as at 15°, 25°, etc. In some embodiments, though not depicted, a position of valve ring 231 may include slots 243 such that in a position, all manifold orifices 221*a-d* are open. The position shown in FIG. 7B (all manifold orifices 221*a-d* being partially open) may be used to create a substantially neutral steering tendency of downhole steering tool 100 by exerting the same amount of force on each steering blade 103, and in some embodiments, this valve position is used to drill a substantially straight borehole, including and but not limited to long tangent sections and horizontal sections, with some drop tendency compensation and course correction. Additionally, in some embodiments, the extension of each steering blade 103 by the same amount of force may cause all steering blades 103 to contact wellbore 15 and grip thereagainst, thereby, for example and without limitation, reducing rotation of slowly rotating housing 101.

Figure 11:
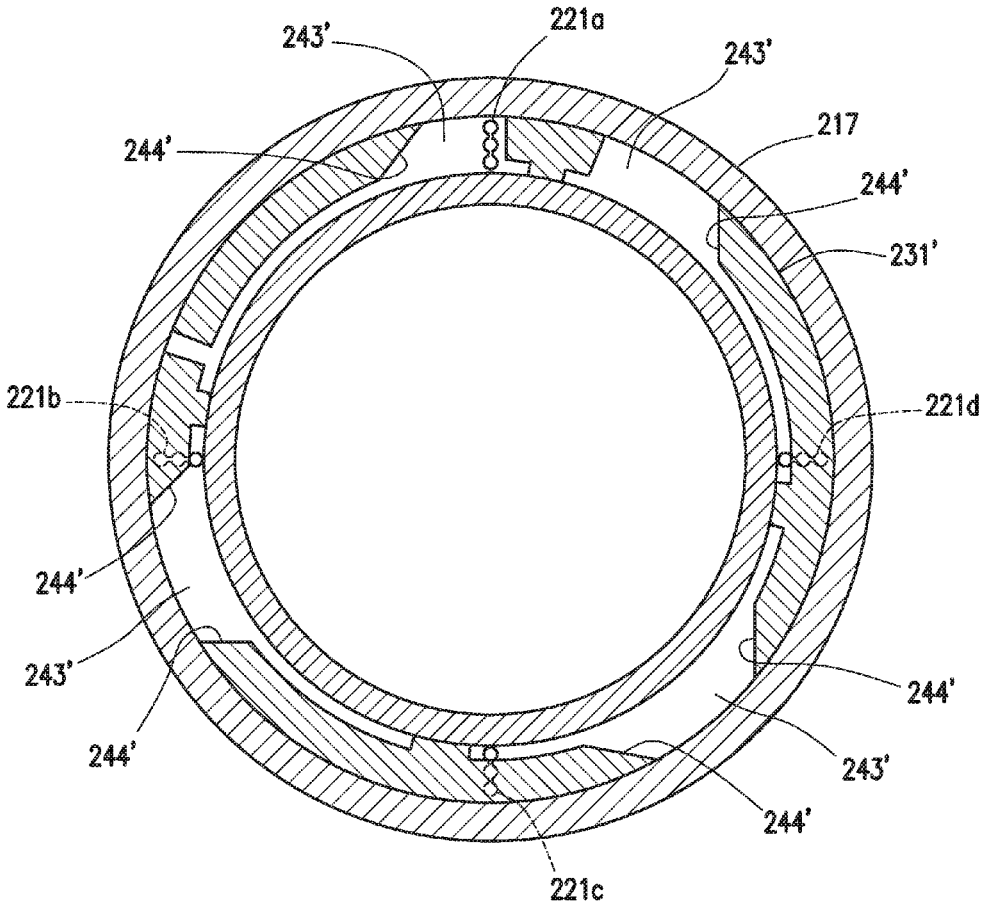
FIG. 11 depicts a semitransparent view of a ring valve consistent with at least one embodiment of the present disclosure.

In some embodiments, as depicted in FIG. 11, valve ring 231' may include one or more slots 243' which may include taper 244'. Taper 244' may, when aligned with manifold orifices 221*a-d*, partially open one or more of manifold orifices 221*a-d* depending on the rotational position of valve ring 231'. Therefore, each of manifold orifices 221*a-d* may be partially opened and closed as valve ring 231' is rotated. In some embodiments, taper 244' may be formed in lip 249'. In some embodiments, as valve ring 231' is rotated, steering blades 103*a-d* as previously discussed may be extended with variable force depending on how much of the respective manifold orifice 221*a-d* is opened by taper 244'. In some embodiments, the rotation of valve ring 231' may be controlled, for example and without limitation, such that it is rotatable to a known degree increment, referred to herein as a "step." In some embodiments, for example and without limitation, each step may be 0.2°, thereby allowing a fine adjustment of the force-vector direction imparted by steering blades 103*a-d* controlled by manifold orifices 221*a-d* respectively. For example, where, as discussed herein above, adjacent valve ring angular positions are separated by 10°, a 0.2° step would allow 50 intermediate positions of valve ring 231' to be reached. The force-vector direction imparted by steering blades 103*a-d* may, in such an embodiment, therefore be controlled at 0.9° increments or having 400 discrete force-vector directions. One having ordinary skill in the art with the benefit of this disclosure will understand that by changing the degree increment of the step, the number of discrete force-vector directions may be modified without deviating from the scope of this disclosure. The ability to finely adjust the force-vector direction of downhole tool 100 may thereby allow the force-vector direction to be adjusted at a fine increment to, for example and without limitation, align with the desired direction of propagation of wellbore 15.

In some embodiments, the rotation of ring valve 231' between a position in which one or more manifold orifices 221*a-d* are open to a position in which one or more manifold orifices 221*a-d* are closed may require a large amount of torque on motor 235. This increase in torque required may, for example and without limitation, require a higher peak current and therefore larger amount of power to be supplied to motor 235. This increase in torque required due to the increasing pressure drop across manifold orifices 221*a-d* as they are closed may, for example and without limitation, cause ring valve 231' to get stuck, jam, or otherwise not be able to close the respective manifold orifice 221*a-d*.

Figure 13:
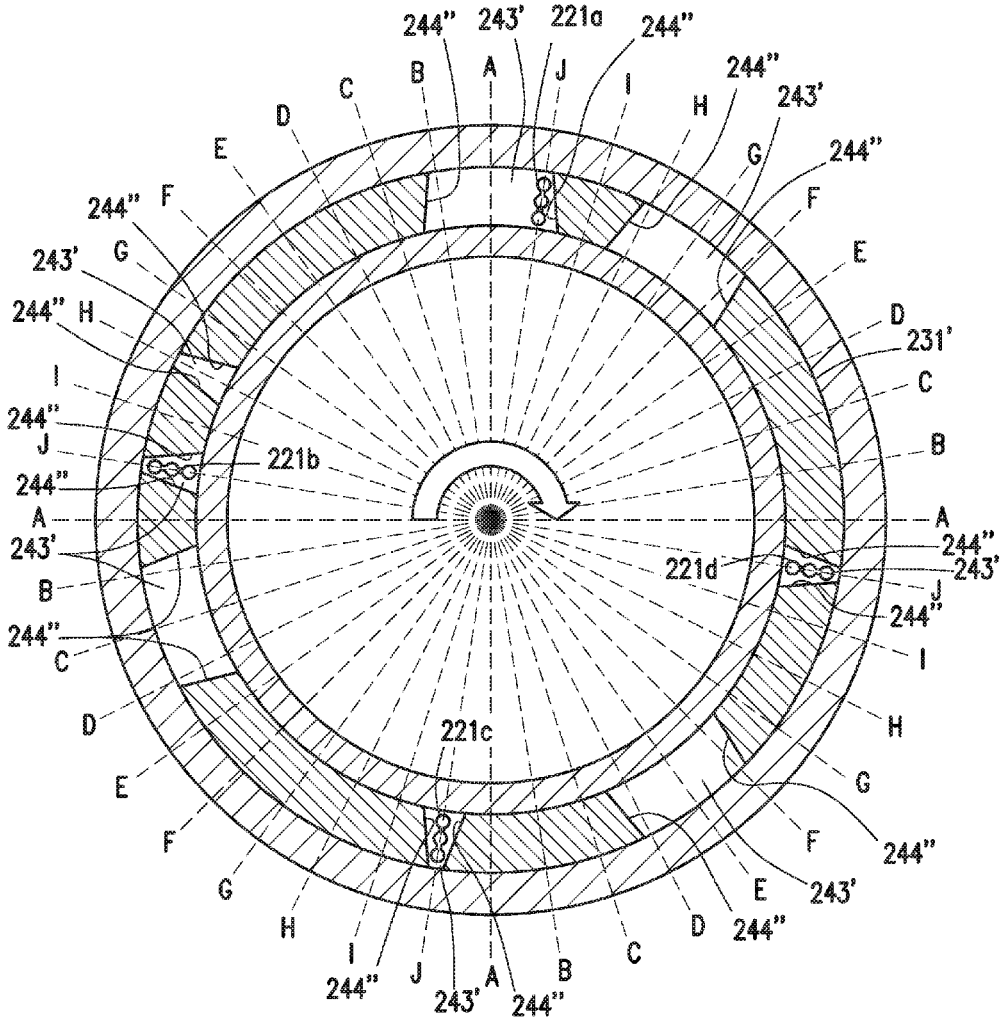
FIG. 13 depicts a semitransparent view of a ring valve consistent with at least one embodiment of the present disclosure.

In some embodiments, as depicted in FIG. 13, valve ring 231' may be rotated to different angular positions (labeled A-J) such that slots 243' open or close one or more of manifold orifices 221*a-d* as outlined in Table 2 below:

TABLE 2

Ring Valve Positions FIG. 13

| Position | Valve Ring Angular Position | Orifice 1 (221a) | Orifice 2 (221b) | Orifice 3 (221c) | Orifice 4 (221d) |
|---|---|---|---|---|---|
| A | 0° | OPEN | CLOSED | CLOSED | CLOSED |
| B | 9° | OPEN | OPEN | CLOSED | CLOSED |
| C | 18° | CLOSED | OPEN | CLOSED | CLOSED |
| D | 27° | CLOSED | OPEN | OPEN | CLOSED |
| E | 36° | CLOSED | CLOSED | OPEN | CLOSED |
| F | 45° | CLOSED | CLOSED | OPEN | OPEN |
| G | 54° | CLOSED | CLOSED | CLOSED | OPEN |
| H | 63° | OPEN | CLOSED | CLOSED | OPEN |
| I | 74° | CLOSED | CLOSED | CLOSED | CLOSED |
| J | 81° | OPEN | OPEN | OPEN | OPEN |

In such an embodiment, with reference to FIG. 13, slots 243' may allow all manifold orifices 221*a-d* to be fully opened when valve ring 231' is positioned such that manifold orifices 221*a-d* are aligned with, for example and without limitation, the 81° position denoted J in FIG. 13. Position J may be positioned radially adjacent to a position in which all manifold orifices 221*a-d* are fully closed, such as, for example and without limitation, the 74° position denoted I in FIG. 13. In some embodiments, each slot 243' may include taper 244" allowing, for example and without limitation, valve ring 231' to gradually close the respective manifold orifice 221*a-d* to be closed as valve ring 231' rotates between positions. Tapers 244" may, for example and without limitation, reduce the torque required to move valve ring 231' when closing manifold orifices 221*a-d*, and thereby reducing the chance of valve ring 231' getting stuck or jammed as valve ring 231' is moved between positions and reducing peak current or power supplied to the motor 235.

Figure 14:
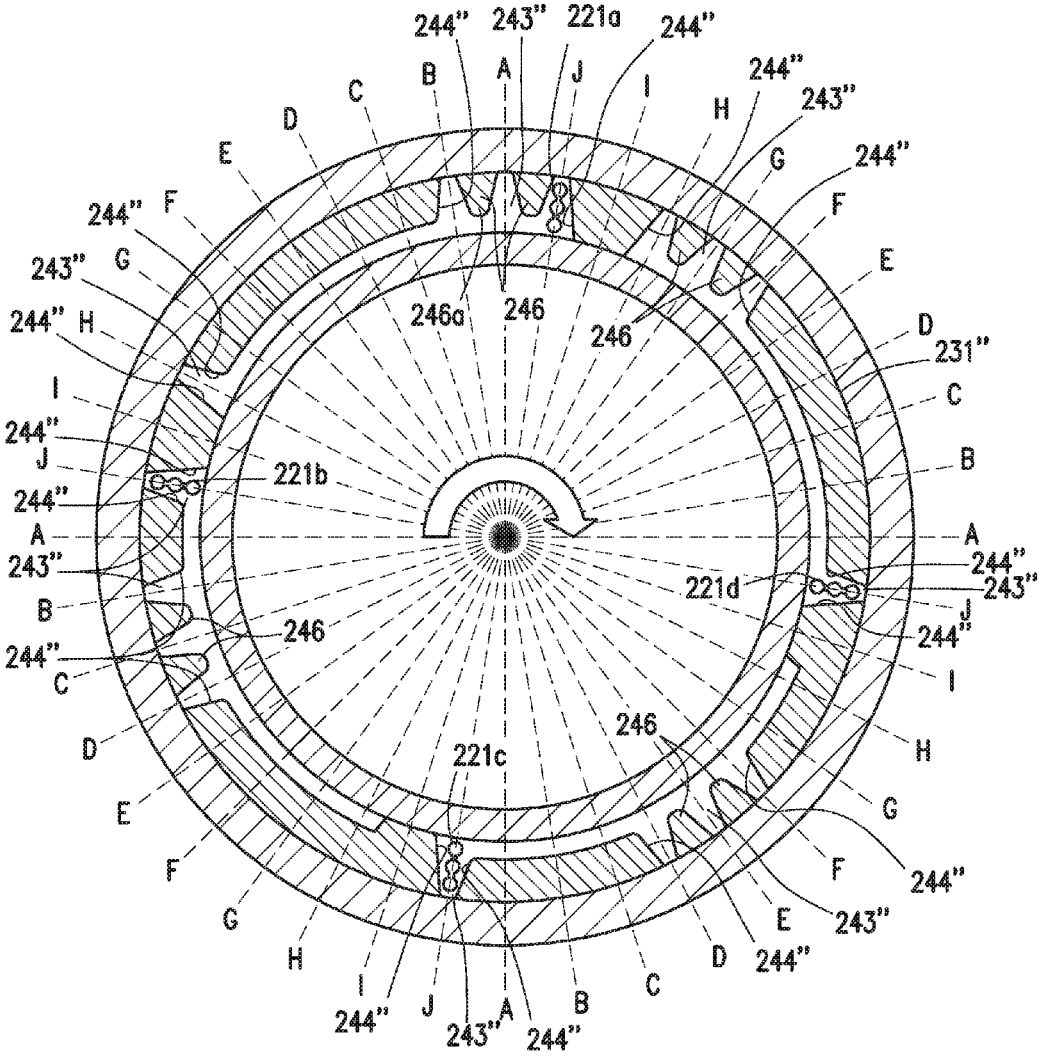
FIG. 14 depicts a semitransparent view of a ring valve consistent with at least one embodiment of the present disclosure.

In some embodiments, valve ring 231" as depicted in FIG. 14 may operate substantially as described with respect to FIG. 13, such that valve ring 231" may be rotated to different angular positions (labeled A-J) such that slots 243" open, partially open, or close one or more of manifold orifices 221*a-d* as outlined in Table 2 below:

TABLE 3

Ring Valve Positions FIG. 14

| Position | Valve Ring Angular Position | Orifice 1 (221a) | Orifice 2 (221b) | Orifice 3 (221c) | Orifice 4 (221d) |
|---|---|---|---|---|---|
| A | 0° | OPEN | PARTIALLY OPEN | PARTIALLY OPEN | PARTIALLY OPEN |
| B | 9° | OPEN | OPEN | PARTIALLY OPEN | PARTIALLY OPEN |
| C | 18° | PARTIALLY OPEN | OPEN | PARTIALLY OPEN | PARTIALLY OPEN |
| D | 27° | PARTIALLY OPEN | OPEN | OPEN | PARTIALLY OPEN |
| E | 36° | PARTIALLY OPEN | PARTIALLY OPEN | OPEN | PARTIALLY OPEN |
| F | 45° | PARTIALLY OPEN | PARTIALLY OPEN | OPEN | OPEN |
| G | 54° | PARTIALLY OPEN | PARTIALLY OPEN | PARTIALLY OPEN | OPEN |
| H | 63° | OPEN | PARTIALLY OPEN | PARTIALLY OPEN | OPEN |
| I | 74° | CLOSED | CLOSED | CLOSED | CLOSED |
| J | 81° | OPEN | OPEN | OPEN | OPEN |

In some embodiments, valve ring 231" may include intermediate projections 246 positioned between certain adjacent positions in which rotation of valve ring 231" would not otherwise close or partially close the respective manifold orifice 221*a-d*. For example, intermediate projection 246*a* may, as depicted in FIG. 14, cause partial closing of manifold orifice 221*a* as valve ring 231" rotates between position A and position B. In such an embodiment, the arrangement of intermediate projections 246 and slots 243" may partially close all manifold orifices 221*a-d* at intermediate positions between one or more of positions A-J. For example, intermediate projections 246 may be positioned to partially close manifold orifice 221*a* at intermediate positions between positions J and A and between positions A and B, partially close manifold orifice 221*b* at intermediate positions between B and C and between positions C and D, partially close manifold orifice 221*c* at intermediate positions between D and E and between positions E and F, and partially close manifold orifice 221*d* at intermediate positions between F and G and between positions G and H as valve ring 231" rotates between positions, placing each respective manifold orifice 221*a-d* in the above described partially open position. In some embodiments, with all four manifold orifices 221*a-d* may cause the same amount of force to be applied to each steering blade 103 as described herein above. In some embodiments, valve ring 231" may be intentionally rotated to one of the intermediate positions, defined as between positions A and B, B and C, C and D, D and E, E and F, F and G, G and H, H and I, I and J, or J and A, allowing for such a condition to be reached. In some such embodiments, the intermediate positions may be reached by a rotation of 4.5° of valve ring 231" from any of positions A-J.

Figure 12:
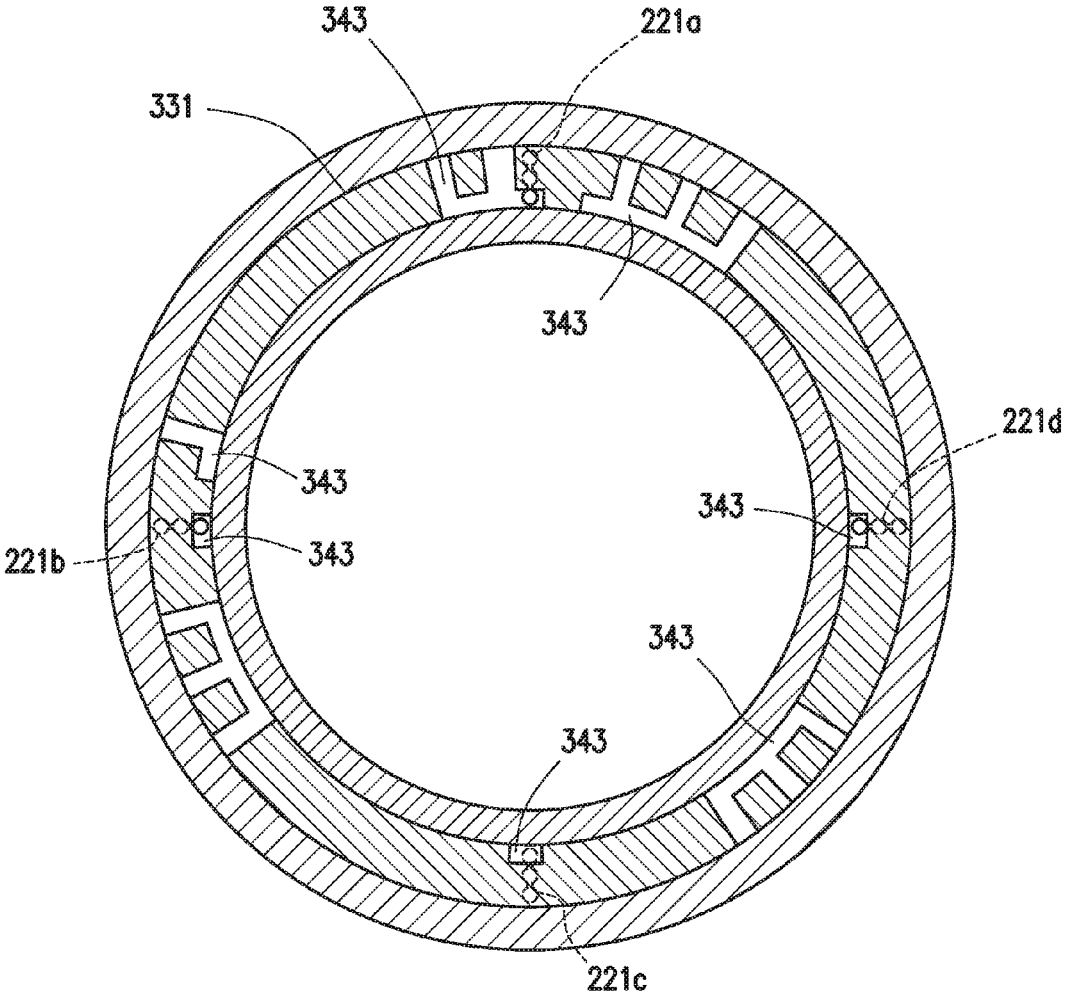
FIG. 12 depicts a semitransparent view of a ring valve consistent with at least one embodiment of the present disclosure.

In some embodiments, as depicted in FIG. 12, valve ring 331 may include slots 343 and may not include a lip such as lip 249 as described herein above. In such embodiments, slots 343 may be arranged such that depending on the rotational position of valve ring 331, each of manifold orifices 221*a-d* may be opened, partially opened, or closed. In some such embodiments, slots 343 may be arranged about valve ring 331 such that manifold orifices 221*a-d* opposite one another are not open at the same time. In some embodiments, slots 343 may be arranged such that manifold orifices 221*a-d* may be opened at the same time. In some embodiments, slots 343 may be arranged such that at a certain rotational position of valve ring 331, all manifold orifices 221*a-d* may be partially open as depicted in FIG. 12. For example, in some embodiments, positions of valve ring 331 may result in the opening and closing of manifold orifices 221*a-d* as outlined in Table 2.

TABLE 4

Ring Valve Positions FIG. 12

| Valve Ring Angular Position | Orifice 1 (221a) | Orifice 2 (221b) | Orifice 3 (221c) | Orifice 4 (221d) |
|---|---|---|---|---|
| 0° | PARTIALLY OPEN | PARTIALLY OPEN | PARTIALLY OPEN | PARTIALLY OPEN |
| 5°* | OPEN | CLOSED | CLOSED | CLOSED |
| 15° | OPEN | OPEN | CLOSED | CLOSED |
| 25° | CLOSED | OPEN | CLOSED | CLOSED |
| 35° | CLOSED | OPEN | OPEN | CLOSED |
| 45° | CLOSED | CLOSED | OPEN | CLOSED |
| 55° | CLOSED | CLOSED | OPEN | OPEN |
| 65° | CLOSED | CLOSED | CLOSED | OPEN |
| 75° | OPEN | CLOSED | CLOSED | OPEN |
| −5° | CLOSED | CLOSED | CLOSED | CLOSED |

In some embodiments, downhole steering tool 100 may transmit data to the surface or to other downhole tools, including but not limited to an MWD tool, LWD tool, instrumented motor, instrumented turbine, instrumented gear-reduced turbine, instrumented axial oscillation tool, instrumented stick-slip mitigation tool, instrumented steady-weight-on-bit tool, instrumented reamer, instrumented underreamer, and instrumented drill bit. In some embodiments, for example and without limitation, a series of pressure pulses may be utilized to transmit communication signals. The pressure pulses may be generated by the opening and closing of one or more steering ports 107 by solenoids 115 or ring valve 215.

In some embodiments, solenoids 115 may be used to generate pressure pulses by opening and closing one or more solenoids 115. As an example utilizing ring valve 215, valve ring 231 may be rotated between a first position corresponding to a minimum pressure drop, i.e. where all manifold orifices 221*a-d* are closed, to a position corresponding to a higher pressure drop, such as where all manifold orifices 221*a-d* are open. For example, such a transition may be achieved by a rotation of valve ring 231' or 231" between positions I and J as described with respect to FIGS. 13, 14. As another example, valve ring 231 may be moved between a position in which one manifold orifice 221*a-d* and a position where two are open.

Figure 15:
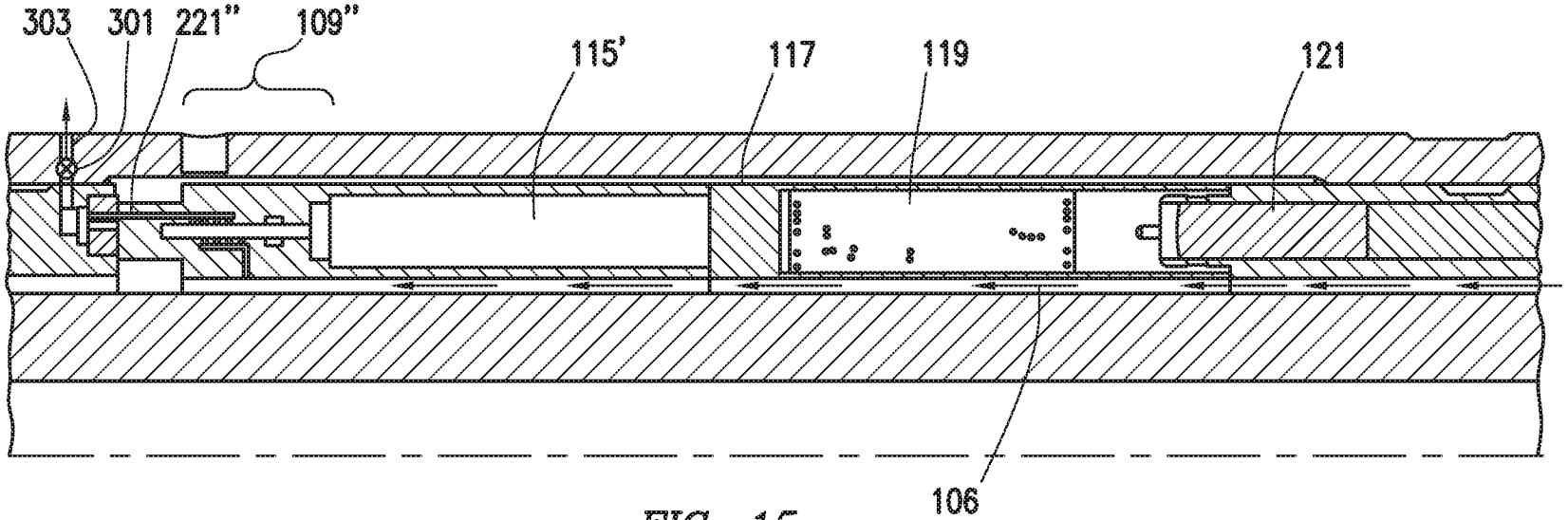
FIG. 15 depicts a partial cross section view of a downhole tool consistent with at least one embodiment of the present disclosure.

In some embodiments, downhole tool 100 may include a dedicated port 109" as depicted in FIG. 15 having a solenoid 115' associated therewith or having a manifold orifice 221" associated therewith to bypass a percentage of the internal mud flow to the annulus through a choke 301 or orifice 303 could be used. In such an embodiment, dedicated port 109" may be added to generate a stronger pressure pulse than the steering ports 107. One having ordinary skill in the art with the benefit of this disclosure will understand that although shown with solenoid 115', manifold orifice 221" may be used with a valve ring consistent with any other embodiment described herein.

In some embodiments, the pressure pulses may be utilized to transmit a signal to the surface or other downhole tools, including but not limited to an MWD tool, LWD tool, instrumented motor, instrumented turbine, instrumented gear-reduced turbine, instrumented axial oscillation tool, instrumented stick-slip mitigation tool, instrumented steady-weight-on-bit tool, instrumented reamer, instrumented underreamer and instrumented drill bit. In some embodiments, the pressure pulses may be utilized to transmit a binary signal. In some embodiments, the pressure-pulse amplitude, frequency, phase or any combination thereof may be utilized to transmit a binary signal. In some embodiments, Manchester encoding may be utilized to transmit data to the surface, including but not limited to inclination, azimuth, housing gravity/magnetic toolface, target toolface, actual toolface, housing rotation speed, bit rotation speed, shock/vibration severities, temperatures, pressure, other diagnostic information, received downlink command/signal, downlink command/signal reception confirmation, downhole software operation mode/state and other data relating to the operation of one or more downhole tools.

Although described with respect to a slowly rotating housing 101, one having ordinary skill in the art with the benefit of this disclosure will understand that rotation speed of housing 101 is not limited to the above mentioned rotation speeds, The steering direction may be controlled with any rotation speed. Additionally, the specific arrangements described herein of slots 243, 243' of valve rings 231, 231', 331 including any tapers 244', 244" are exemplary and are not intended to limit the scope of this disclosure. Combinations of the described arrangements as well as other arrangements of slots and valve rings may be utilized without deviating from the scope of this disclosure.

The methods described herein are configured for downhole implementation via one or more controllers deployed downhole (e.g., in a vertical/directional drilling tool). A suitable controller may include, for example, a programmable processor, such as a microprocessor or a microcontroller and processor-readable or computer-readable program code embodying logic. A suitable processor may be utilized, for example, to execute the method embodiments described above with respect to FIGS. 7A-J, and 10A-D as well as the corresponding disclosed mathematical equations for gravity/magnetic toolface. A suitable controller may also optionally include other controllable components, such as sensors (e.g., a temperature sensor), data storage devices, power supplies, timers, and the like. The controller may also be disposed to be in electronic communication with the other sensors (e.g., to receive the continuous inclination and azimuth measurements). A suitable controller may also optionally communicate with other instruments in the drill string, such as, for example, telemetry systems that communicate with the surface. A suitable controller may further optionally include volatile or non-volatile memory or a data storage device.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A downhole tool comprising:

a housing rotatably coupled to and positioned about a mandrel;

a steering blade positioned on the housing, the steering blade extendable by an extension force to contact a wellbore, the extension force caused by a differential pressure between a steering cylinder and a pressure in a surrounding wellbore, the differential pressure caused by fluid pressure of a fluid within the steering cylinder, the steering cylinder within the housing, the steering blade at least partially positioned within the steering cylinder, the steering cylinder fluidly coupled to a steering port; and an adjustable orifice, the adjustable orifice fluidly coupled between the interior of the mandrel and the steering cylinder, the adjustable orifice adjustable between an open position and at least one of a partially open position and a closed position wherein the adjustable orifice includes:

a valve cylinder, the valve cylinder including:

two or more input ports, the input ports fluidly coupled to the interior of the mandrel; and two or more output ports fluidly coupled to the steering port, the output ports aligned with the input ports; and a piston movable from a partially open position to an open position by a solenoid, the piston including two or more radial grooves, such that when the piston is in the open position, each radial groove fluidly couples an input port of the two or more input ports with a corresponding output port of the two or more output ports, and when in the partially open position, at least one input port is fluidly disconnected from the corresponding output port.

2. The downhole tool of claim 1, wherein at least one radial groove of the two or more radial grooves is wider than at least one other radial groove of the two or more radial grooves.

3. The downhole tool of claim 1, further comprising a second adjustable orifice, the second adjustable orifice fluidly coupled between the interior of the mandrel and a second steering cylinder, the second adjustable orifice adjustable between an open position and a partially open position.

4. The downhole tool of claim 3, wherein the second adjustable orifice comprises:

a second valve cylinder; and a second piston movable from a partially open position to an open position by a second solenoid.

5. The downhole tool of claim 1, further comprising a controller electrically coupled to the adjustable orifice.

6. The downhole tool of claim 5, wherein the controller comprises one or more microcontrollers, microprocessors, FPGAs (field programmable gate arrays), or analog integrated circuits.

7. The downhole tool of claim 5, wherein the controller is electrically coupled to one or more sensors.

8. The downhole tool of claim 7, further comprising a differential rotation sensor positioned to detect the relative rotation between the housing and the mandrel.

9. The downhole tool of claim 8, wherein the differential sensor comprises one or more infrared sensors, ultrasonic sensors, Hall-effect sensors, fluxgate magnetometers, magneto-resistive magnetic-field sensors, micro-electro-mechanical system (MEMS) magnetometers, or pick-up coils.

10. The downhole tool of claim 9, further comprising a magnet coupled to the mandrel.

11. The downhole tool of claim 7, further comprising a housing rotation measurement sensor.

12. The downhole tool of claim 11, wherein the housing rotation sensor comprises one or more accelerometers, magnetometers, or gyroscopic sensors.

13. The downhole tool of claim 1, wherein the fluid is drilling mud, air, mist, foam, water, oil, or hydraulic fluid.

14. A downhole tool comprising:

a housing rotatably coupled to and positioned about a mandrel;

a steering blade positioned on the housing, the steering blade extendable by an extension force to contact a wellbore, the extension force caused by a differential pressure between a steering cylinder and a pressure in a surrounding wellbore, the differential pressure caused by fluid pressure of a fluid within the steering cylinder, the steering cylinder within the housing, the steering blade at least partially positioned within the steering cylinder, the steering cylinder fluidly coupled to a steering port; and an adjustable orifice, the adjustable orifice fluidly coupled between the interior of the mandrel and the steering cylinder, the adjustable orifice adjustable between an open position and at least one of a partially open position and a closed position, wherein the adjustable orifice comprises a manifold orifice of a ring valve, the ring valve including:

a manifold, the manifold orifice formed in an upper manifold surface of the manifold, the manifold orifice coupled to the steering port; and a valve ring, the valve ring having a lower ring surface positioned in abutment with the upper manifold surface, the valve ring having a slot formed in the lower ring surface, the valve ring rotatable relative to the manifold.

15. The downhole tool of claim 14, wherein the valve ring is positioned in a first valve ring angular position and the slot is aligned with the manifold orifice.

16. The downhole tool of claim 15, wherein the lip is discontinuous, such that the manifold orifice is closed when the valve ring is at a fourth valve ring angular position.

17. The downhole tool of claim 14, further comprising:

a second steering blade positioned on the housing, the second steering blade extendable by an extension force to contact a wellbore, the extension force caused by a second differential pressure between a second steering cylinder and the pressure in the surrounding wellbore, the differential pressure caused by fluid pressure of a fluid within the second steering cylinder, the second steering cylinder within the housing, the second steering blade at least partially positioned within the second steering cylinder, the second steering cylinder fluidly coupled to a second steering port; and wherein the manifold further comprises a second manifold orifice fluidly coupled to the second steering port; and wherein the valve ring further comprises a second slot formed in the lower ring surface.

18. The downhole tool of claim 17, wherein the valve ring is positioned in a second valve ring angular position and the second slot is aligned with the second manifold orifice.

19. The downhole tool of claim 17, wherein the second slot is aligned with the second manifold orifice when the valve ring is positioned in the first valve ring angular position.

20. The downhole tool of claim 17, wherein the ring valve is positioned in a third valve ring angular position and the slot is not aligned with the manifold orifice.

21. The downhole tool of claim 14, wherein the lower ring surface further comprises a lip positioned such that the manifold orifice is partially open when the slot is not aligned with the manifold orifice.

22. The downhole tool of claim 14, further comprising a valve ring position sensor.

23. The downhole tool of claim 22, wherein the valve ring position sensor comprises one or more pick-up coils, magnetometers, Hall-effect sensors, mechanical position sensors, or optical position sensors.

24. The downhole tool of claim 14, wherein the valve ring is coupled to a motor.

25. The downhole tool of claim 24, wherein the motor is a brushless direct current motor.

26. The downhole tool of claim 24, wherein the valve ring is coupled to the motor by a drive ring and pinion or by a gearbox.

27. The downhole tool of claim 14, wherein the slot further comprises a taper.

28. A method comprising:

providing a downhole tool, the downhole tool including a housing rotatably coupled to and positioned about a mandrel;

a first steering blade positioned on the housing, the first steering blade extendable by an extension force to contact a wellbore, the extension force caused by a first differential pressure between a first steering cylinder and a pressure in a surrounding wellbore, the first differential pressure caused by fluid pressure of a fluid within the first steering cylinder, the first steering cylinder within the housing, the first steering blade at least partially positioned within the first steering cylinder, the first steering cylinder fluidly coupled to a steering port; and a first adjustable orifice, the first adjustable orifice fluidly coupled between an interior of the mandrel and the first steering cylinder, the first adjustable orifice adjustable between an open position and at least one of a partially open position and a closed position wherein the first adjustable orifice comprises a valve cylinder, the valve cylinder including:

two or more input ports, the input ports fluidly coupled to the interior of the mandrel; and two or more output ports fluidly coupled to the steering port, the output ports aligned with the input ports; and a piston movable from a partially open position to an open position by a solenoid, the piston including two or more radial grooves, such that when the piston is in the open position, each radial groove fluidly couples an input port of the two or more input ports with a corresponding output port of the two or more output ports, and when in the partially open position, at least one input port is fluidly disconnected from the corresponding output port;

positioning the downhole tool in the wellbore;

supplying the fluid to the interior of the mandrel, the fluid at a pressure higher than the pressure in the surrounding wellbore;

partially opening the adjustable orifice by moving the piston to the partially open position by the solenoid;

extending the first steering blade with a first extension force;

opening the adjustable orifice by moving the piston to the open position by the solenoid; and extending the first steering blade with a second extension force, the second extension force being higher than the first extension force.

29. The method of claim 28, wherein the downhole tool further comprises:

a second steering blade positioned on the housing, the second steering blade extendable by an extension force to contact a wellbore, the extension force caused by a second differential pressure between a second steering cylinder and the pressure in the surrounding wellbore, the differential pressure caused by fluid pressure of a fluid within the second steering cylinder, the second steering cylinder within the housing, the second steering blade at least partially positioned within the second steering cylinder, the second steering cylinder fluidly coupled to a second steering port; and a second adjustable orifice, the second adjustable orifice fluidly coupled between the interior of the mandrel and the second steering cylinder, the second adjustable orifice adjustable between an open position and a partially open position;

wherein the method further comprises:

partially opening the second adjustable orifice;

extending the second steering blade with a first extension force;

opening the second adjustable orifice; and extending the second steering blade with a second extension force, the second extension force being higher than the first extension force.

30. The method of claim 29, further comprising:

partially opening the first adjustable orifice while the second adjustable orifice is open;

extending the first steering blade with a first extension force; and extending the second steering blade with a second extension force, the second extension force being higher than the first extension force.

31. A method comprising:

providing a downhole tool, the downhole tool including a housing rotatably coupled to and positioned about a mandrel;

a first steering blade positioned on the housing, the first steering blade extendable by an extension force to contact a wellbore, the extension force caused by a first differential pressure between a first steering cylinder and a pressure in a surrounding wellbore, the first differential pressure caused by fluid pressure of a fluid within the first steering cylinder, the first steering cylinder within the housing, the first steering blade at least partially positioned within the first steering cylinder, the first steering cylinder fluidly coupled to a steering port; and a first adjustable orifice, the first adjustable orifice fluidly coupled between an interior of the mandrel and the first steering cylinder, the first adjustable orifice adjustable between an open position and at least one of a partially open position and a closed position, the first adjustable orifice being a manifold orifice of a ring valve, the ring valve including:

a manifold, the manifold orifice formed in an upper manifold surface of the manifold, the manifold orifice coupled to the steering port; and a valve ring, the valve ring having a lower ring surface positioned in abutment with the upper manifold surface, the valve ring having a slot formed in the lower ring surface, the valve ring rotatable relative to the manifold;

opening the first adjustable orifice by rotating the valve ring to a position such that the slot is aligned with the manifold orifice; and extending the first steering blade with a second extension force.

32. The method of claim 31, further comprising closing the first adjustable orifice by rotating the ring valve to a position such that the slot is not aligned with the manifold orifice.

33. The method of claim 31, wherein the valve ring further comprises a lip formed in the lower ring surface, and the method further comprises:

partially opening the first adjustable orifice by rotating the ring valve to a position such that the slot is not aligned with the manifold orifice and the lip is aligned with the manifold orifice; and extending the first steering blade with a first extension force, the first extension force being lower than the second extension force.

34. A method of transmitting data from a downhole tool comprising:

positioning the downhole tool in a wellbore, the downhole tool comprising:

a housing rotatably coupled to and positioned about a mandrel;

a steering blade positioned on the housing, the steering blade extendable by an extension force to contact a wellbore, the extension force caused by a differential pressure between a steering cylinder and a pressure in a surrounding wellbore, the differential pressure caused by fluid pressure of a fluid within the steering cylinder, the steering cylinder within the housing, to contact a wellbore, the steering blade at least partially positioned within the steering cylinder, the steering cylinder fluidly coupled to a steering port; and an adjustable orifice, the adjustable orifice fluidly coupled between the interior of the mandrel and the steering cylinder, the adjustable orifice adjustable between an open position, a partially open position, and a closed position wherein the adjustable orifice comprises:

a valve cylinder, the valve cylinder including:

two or more input ports, the input ports fluidly coupled to the interior of the mandrel; and two or more output ports fluidly coupled to the steering port, the output ports aligned with the input ports; and a piston movable from a partially open position to an open position by a solenoid, the piston including two or more radial grooves, such that when the piston is in the open position, each radial groove fluidly couples an input port of the two or more input ports with a corresponding output port of the two or more output ports, and when in the partially open position, at least one input port is fluidly disconnected from the corresponding output port; and generating one or more pressure pulses by selectively adjusting the adjustable orifice between the open and partially closed position, between the open and closed position, or between the partially open and closed position.

35. The method of claim 34, wherein generating one or more pressure pulses comprises moving the piston from the partially open position to the open position.

36. The method of claim 34, wherein the step of generating one or more pressure pulses by selectively adjusting the adjustable orifice between the open and partially closed position is accomplished by flowing the fluid through the adjustable orifice.

37. The method of claim 34, wherein the fluid is drilling mud, air, mist, foam, water, oil, or hydraulic fluid.

38. A method of transmitting data from a downhole tool comprising:

positioning the downhole tool in a wellbore, the downhole tool comprising:

a housing rotatably coupled to and positioned about a mandrel;

a steering blade positioned on the housing, the steering blade extendable by an extension force to contact a wellbore, the extension force caused by a differential pressure between a steering cylinder and a pressure in a surrounding wellbore, the differential pressure caused by fluid pressure of a fluid within the steering cylinder, the steering cylinder within the housing, to contact a wellbore, the steering blade at least partially positioned within the steering cylinder, the steering cylinder fluidly coupled to a steering port; and an adjustable orifice, the adjustable orifice fluidly coupled between the interior of the mandrel and the steering cylinder, the adjustable orifice adjustable between an open position, a partially open position, and a closed position, wherein the adjustable orifice comprises a manifold orifice of a ring valve, the ring valve including:

a manifold, the manifold orifice formed in an upper manifold surface of the manifold, the manifold orifice coupled to the steering port; and a valve ring, the valve ring having a lower ring surface positioned in abutment with the upper manifold surface, the valve ring having a slot formed in the lower ring surface, the valve ring rotatable relative to the manifold wherein the manifold orifice is open when the slot is aligned therewith;

generating one or more pressure pulses by selectively adjusting the adjustable orifice between the open and partially closed position, between the open and closed position, or between the partially open and closed position.

39. The method of claim 38, wherein generating one or more pressure pulses comprises rotating the valve ring from a first valve ring angular position in which the slot is aligned with the manifold orifice to a second valve ring angular position in which the slot is not aligned with the manifold orifice.

* * * * *